US007697877B2

(12) United States Patent
Asakura et al.

(10) Patent No.: US 7,697,877 B2
(45) Date of Patent: Apr. 13, 2010

(54) IMAGE FORMING APPARATUS EMPLOYING HEATING AND FIXER FLUID APPLYING SECTIONS

(75) Inventors: Kenji Asakura, Kyoto (JP); Shinji Yamana, Yamatokoriyama (JP); Yukikazu Kamei, Chiba (JP)

(73) Assignee: Sharp Kabushiki Kaisha, Osaka (JP)

( * ) Notice: Subject to any disclaimer, the term of this patent is extended or adjusted under 35 U.S.C. 154(b) by 819 days.

(21) Appl. No.: 11/304,657

(22) Filed: Dec. 16, 2005

(65) Prior Publication Data

US 2006/0133863 A1 Jun. 22, 2006

(30) Foreign Application Priority Data

Dec. 17, 2004 (JP) ..... P2004-366283
Nov. 16, 2005 (JP) ..... P2005-332022

(51) Int. Cl.
*G03G 15/20* (2006.01)

(52) U.S. Cl. ..... 399/307

(58) Field of Classification Search ..... 399/307, 399/302, 308
See application file for complete search history.

(56) References Cited

U.S. PATENT DOCUMENTS

| | | | | |
|---|---|---|---|---|
| 5,890,043 | A | 3/1999 | Uehara | |
| 6,141,524 | A * | 10/2000 | Berkes et al. | 399/307 |
| 7,274,898 | B2 * | 9/2007 | Nousho et al. | 399/159 |
| 2003/0044203 | A1 * | 3/2003 | Watanabe | 399/302 |
| 2004/0131402 | A1 | 7/2004 | Kurotori et al. | |
| 2007/0253757 | A1 * | 11/2007 | Tanaka et al. | 399/340 |

FOREIGN PATENT DOCUMENTS

| | | | |
|---|---|---|---|
| JP | 59-119364 | A | 7/1984 |
| JP | 63-66576 | A | 3/1988 |
| JP | 1-269970 | A | 10/1989 |
| JP | 10-063121 | | 3/1998 |
| JP | 2000-293050 | A | 10/2000 |
| JP | 2002091179 | A * | 3/2002 |
| JP | 2004-109747 | | 4/2004 |
| JP | 2004-109751 | A | 4/2004 |
| JP | 2004-151626 | | 5/2004 |
| JP | 2004-294847 | | 10/2004 |

OTHER PUBLICATIONS

Computer translation of cited reference JP2004-294847A.*

* cited by examiner

*Primary Examiner*—Quana M Grainger
(74) *Attorney, Agent, or Firm*—Nixon & Vanderhye P.C.

(57) ABSTRACT

An image forming apparatus is provided in which a toner is prevented from flowing and being agglomerated, at the time of application of a fixer fluid to a toner image so as to fix the toner image to a recording medium, and the recording medium is prevented from generating curl and wrinkle, and consumption of the fixer fluid and electricity can be reduced, and even a multicolored toner image can be fixed for a relatively short time. An image forming apparatus includes a toner image forming section, an intermediate transfer section, a secondary transfer section, a heating section, a fixer fluid applying section, and a recording medium supplying section. A recording medium carrying the toner image on a surface thereof is heated by the heating section and then, a fixer fluid is applied to the toner image by the fixer fluid applying section so that the toner image is fixed.

46 Claims, 10 Drawing Sheets

IMAGE FORMING APPARATUS EMPLOYING HEATING AND FIXER FLUID APPLYING SECTIONS

BACKGROUND

1. Technical Field

The presently disclosed technology relates to an image forming apparatus.

2. Description of the Related Art

In an image forming apparatus of electrophotographic system commonly used for copying machine, printer, facsimile and the like, a photoreceptor having a photosensitive layer containing a photoconductive substance formed on a surface thereof is used. In this case, after an electric charge is given to a photoreceptor surface so as to uniformly charge therewith, an electrostatic latent image corresponding to image information is formed by various image forming processes. This electrostatic latent image is developed by a developer supplied from developing means, the developer containing a toner, so as to make a toner image. This toner image is directly transferred to a recording medium such as a paper, or once transferred to an intermediate transfer medium and then further transferred to the recording medium. And in order to fix the toner image transferred to the recording medium onto the recording medium, it is common to heat and pressurize the recording medium by fixing means of thermal fixing system using a developing roller or the like including heating means.

In an image forming apparatus of thermal fixing system, for instance, an intermediate transfer belt serving as the intermediate transfer medium is stretched by a heating roller. By so doing, the intermediate transfer belt and further the toner image formed on the intermediate transfer belt are heated, and transferred and fixed to the recording medium in a heated state (refer to, for instance, Japanese Unexamined Patent Publications JP-A 10-063121). An image forming apparatus disclosed in the JP-A 10-063121 is characterized by relatively small electric power consumption. However, this image forming apparatus has disadvantages of image deteriorations such that the toner image is not fixed and that offset of the toner image is caused, due to decrease of a temperature of the toner image when the toner image and the recording medium come into contact with each other at the time of transfer and fixation because the recording medium is not heated in this image forming apparatus.

In addition, an image forming apparatus is proposed in which the toner image on the intermediate transfer belt is heated as in the JP-A 10-063121 and moreover, the recording medium to which the toner image has not been transferred and fixed, is also heated so as to transfer and fix the toner image to the recording medium in the heated state (refer to, for instance, Japanese Unexamined Patent Publications JP-A 2004-151626).

In the image forming apparatus disclosed in the 2004-151626, fixing strength of the toner image to the recording medium is enhanced, but on the other hand, not only the toner image but also the recording medium are heated. Furthermore, heating means having a large heat capacity becomes necessary for heating the toner image and the recording medium and therefore, the electric power consumption becomes so larger as to occupy more than half of total electric power consumption in the image forming apparatus in the present circumstances. However, at the present time, saving energy is demanded as countermeasures against global warming. Since the image forming apparatus of electrophotographic system is commonly used, it is required also in the image forming apparatus of electrophotographic system to reduce the electric power consumption at the time when the toner is fixed to the recording medium Further, in the thermal fixing system, an interior portion of the apparatus has a high temperature by use of the heating means inside the apparatus as described above and therefore, it is necessary to enhance heat resistance of components, so that a material cost increases. Furthermore, in the thermal fixing system, a fixing operation cannot be performed until when a temperature of a fixing portion increases to the predetermined temperature. Accordingly, it tends to take a long time before the fixing operation can start, which time is a warm-up time in other words. Furthermore, the thermal fixing system has a problem that it takes a longer time for fixing a multicolored toner image to the recording image than fixing a monochromatic toner image. Consequently, it is desired to shorten a fixing time of the multicolored toner image.

In view of such desires, a wet fixing system is known which employs a fixer fluid containing water and a liquid dissolvable or dispersible in water, having an action for softening or swelling the toner. In this system, the toner image is fixed to the recording medium by attaching to the recording medium and pressurizing the toner image formed of the toner which has been made in a softened or swelled state due to application of the fixer fluid. The wet fixing system needs far smaller electric power consumption than that in the thermal fixing system. Accordingly, the wet fixing system is useful from a viewpoint of saving energy. Moreover, the fixing time of the multicolored toner image can be shorter than that in the thermal fixing system because a large heat quantity is not necessary. Consequently, various proposals have been made about further modification of the wet fixing system.

For instance, a fixing apparatus has been proposed in which the fixer fluid is applied from a fixer fluid spraying member having a plurality of pores to only a toner attached portion of the toner image carried on the intermediate transfer medium or recording medium, and then the applied fixer fluid is heated (refer to, for instance, Japanese Unexamined Patent Publications JP-A 2004-109747). That is to say, this fixing apparatus employs a system in which the toner image on the intermediate transfer medium or recording medium is heated after the fixer fluid is applied thereto. However, unfixed toner image is no more than an agglomeration of toner particles without physically or chemically binding force in a room temperature. Accordingly, when a liquid such as the fixer fluid is directly applied to the unfixed toner image, the toner particles are softened and/or swelled so that the toner particles easily become fluid or agglomerated. As a result, a blur is generated on an image edge after fixation and in addition, a halftone portion which should be even, have uneven density so that an image of high quality cannot be obtained. It goes without saying that this state cannot be brought back into good condition even when the toner image is heated after the toner particles become fluid or agglomerated.

Further, in the fixing apparatus disclosed in the JP-A 2004-109747, in a case where the toner image is carried by the intermediate transfer medium, the intermediate transfer belt serving as the intermediate transfer medium is treated with water-shedding processes such as fluorine treatment. Accordingly, even when the fixer fluid is applied to the intermediate transfer belt, the fixer fluid exists only on a toner portion (an image portion) while the fixer fluid does not stagnate on a portion between the toner images, where the toner does not exist (a non-image portion). However, when the fixer fluid is thus applied locally to the recording medium, the image portion expands and contracts while the non-image portion does not expand or contract, and therefore it is not possible to prevent wrinkles from being generated around the image portion. Particularly, in a case where a recording paper manufactured by combining paper fabric dispersed in water is used as the recording medium, this tendency is prominent. As a matter of course, when the fixer fluid of the minimum amount for swelling the toner is applied, such troubles are not caused. However, it is difficult to exactly measure the minimum amount because the minimum amount is extremely small. Further, when the fixer fluid is applied to only the toner attached portion, the toner attached by fog or the like on the non-image portion around the toner attached portion remains on the recording medium without being fixed so that the toner may mess hands, clothes or the like.

Note that in the image forming apparatus in the JP-A 10-063121, it is conceivable that the fixer fluid is applied to the toner image when the toner image on the transfer belt in the heated state is transferred and fixed to the recording medium which has not been heated. However, in order to enhance adherence between the toner image and the recording medium and adherence among the toner particles in a case where heat is not supplied at the time of transfer and fixation, and no other particular measures are taken as in the case of the JP-A 10-063121, a large amount of the fixer fluid becomes necessary. When the large amount of the fixer fluid is used, it is not possible to prevent wrinkles, curls and the like from causing on the recording medium. In addition, it becomes necessary to replenish the fixer fluid with frequency, with the result that maintenance is deteriorated. Alternatively, a high-capacity fixer fluid storing tank becomes necessary, with the result that the apparatus cannot be small in size.

SUMMARY

An object of the presently disclosed technology is to provide an image forming apparatus which causes no disturbance in a toner image due to flux and agglomeration of a toner and which causes no curls, no wrinkles, etc. on a recording medium, at the time of fixing the toner image to the recording medium by use of a liquid fixer fluid, and which can reduce consumption of the fixer fluid and heat energy and electric power consumption, and can fix even a multicolored toner image for a relatively short time.

The presently disclosed technology, an image forming apparatus comprising:

a toner image forming section for forming a toner image;

a transfer section for transferring the toner image formed by the toner image forming section to a recording medium;

a heating section for heating a surface of the recording medium; and a fixer fluid applying section for applying to the surface of the recording medium a fixer fluid for fixing a toner to the recording medium by softening and/or swelling the toner, wherein the heating section and the fixer fluid applying section are disposed so that the surface of the recording medium is heated by the heating section before or during application of the fixer fluid to the recording medium by the fixer fluid applying section.

According to the presently disclosed technology, an image forming apparatus comprises: a toner image forming section; a transfer section for transferring the toner image to a recording medium; a heating section for heating the toner image on the recording medium; and a fixer fluid applying section for applying a fixer fluid to the toner image on the recording medium. In the image forming apparatus, a surface of the recording medium is heated by the heating section before or during application of the fixer fluid to the surface of the recording medium by the fixer fluid applying section.

In the image forming apparatus, the recording medium carrying the toner image is heated, that is to say, the toner image and the recording medium are heated by one heating section. Accordingly, it is possible to heat the toner image and the recording medium to a temperature suitable for fixing the toner image to the recording medium for a short time with a small heat quantity. Moreover, in the apparatus of the presently disclosed technology, since the fixer fluid is applied to the toner image after or simultaneously with heating of the recording medium carrying the toner image, temperatures of the toner image and recording medium appropriately rise so as to increase a liquid temperature of the just-applied fixer fluid, and the fixer fluid swiftly spreads and permeates the toner image. As a result, almost entire toner constituting the toner image is instantly softened and/or swelled so that the toner is prevented from flowing and being agglomerated, and the toner image and the recording medium are solidly attached to each other for a short time. Furthermore, as described before, the liquid temperature of the applied fixer fluid rises and therefore, excess fixer fluid can be dried out for a short time. These advantages contribute to enhancement of throughput that indicates the number of outputted sheets per hour by the image forming apparatus. In addition, wrinkles, curls and the like are not frequently generated on the recording medium.

Further, the presently disclosed technology provides an image forming apparatus comprising:

a toner image forming section for forming a toner image;

an intermediate transfer section serving as a first toner image carrier for transferring the toner image formed by the toner image forming section, the intermediate transfer section including an intermediate transfer medium having at least a surface formed of a material which is not permeated by a fixer fluid for fixing the toner image to a recording medium by softening and/or swelling a toner;

a heating section for heating the intermediate transfer medium or another toner image carrier different therefrom;

a fixer fluid applying section for applying the fixer fluid to the intermediate transfer medium or the other toner image carrier; and a transfuse section for transferring and fixing to the recording medium the toner image to which the fixer fluid has been applied, wherein the heating section and the fixer fluid applying section are disposed so that the intermediate transfer medium or the other toner image carrier is heated by the heating section before or during application of the fixer fluid to the intermediate transfer medium or the other toner image carrier by the fixer fluid applying section.

Further, according to an example embodiment of the presently disclosed technology, an image forming apparatus comprises: a toner image forming section; an intermediate transfer section including an intermediate transfer medium having at least a surface formed of a material which a fixer fluid does not permeate; a heating section for heating a toner image on the intermediate transfer medium or another toner image carrier different therefrom; a fixer fluid applying section for applying the fixer fluid to the toner image on the intermediate transfer medium or the other toner image carrier; and a transfuse section for transferring and fixing to the recording medium the toner image to which the fixer fluid has been applied. In the image forming apparatus, the intermediate transfer medium or the other toner image carrier is heated by the heating section before or during application of the fixer fluid to the intermediate transfer medium by the fixer fluid applying section.

In the image forming apparatus, the intermediate transfer medium or the other toner image carrier carrying the toner image is heated, that is to say, the toner image and the intermediate transfer medium or the other toner image carrier are heated by one heating section. Accordingly, it is possible to heat the toner image and the intermediate transfer medium or the other toner image carrier to a temperature suitable for fixing the toner image to the recording medium for a short time with a small heat quantity. Moreover, in the apparatus of the presently disclosed technology, since the fixer fluid is applied to the toner image after or simultaneously with heating of the intermediate transfer medium or the other toner image carrier carrying the toner image, temperatures of the toner image and intermediate transfer medium or the other toner image carrier appropriately rise so as to increase a liquid temperature of the just-applied fixer fluid, and the fixer fluid swiftly spreads and permeates the toner image. As a result, almost entire toner constituting the toner image is instantly softened and/or swelled so that the toner is prevented from flowing and being agglomerated, and the toner image and the recording medium are solidly attached to each other for a short time. Furthermore, as described before, the liquid temperature of the applied fixer fluid rises and therefore, excess fixer fluid can be dried out for a short time. These advantages contribute to enhancement of throughput that indicates the number of outputted sheets per hour by the image forming apparatus. In addition, wrinkles, curls and the like are not frequently generated on the recording medium.

Moreover, the fixer fluid is applied to the intermediate transfer medium serving as the fist toner image carrier having at least a surface formed of a material which the fixer fluid does not permeate. Accordingly, the fixer fluid is seldom absorbed into the toner image carrier without acting on the toner so that usage of the fixer fluid can be reduced.

Further, in the image forming apparatus, a constant amount of the fixer fluid is applied at any time to the toner image carried by the intermediate transfer medium. Moreover, the intermediate transfer medium is easily provided with sensors such as a temperature detecting sensor. A feed back control by use of the sensor makes it possible to heat the intermediate transfer medium at a constant temperature. Accordingly, under a constant condition, the fixer fluid can be applied to the toner image, and the toner image can be transferred and fixed to the recording medium, so that an image of high quality can be obtained at any time. Note that in a case where the fixer fluid is applied to the recording medium, it is necessary to change an application amount of the fixer fluid depending on types of the recording medium (such as materials, permeability of the fixer fluid, thickness, and the like), and it is not easy to provide a sensor for detecting a surface temperature of the recording medium.

Further, the presently disclosed technology provides an image forming apparatus comprising:

a toner image forming section for forming a toner image;

an intermediate transfer section serving as a first toner image carrier for transferring the toner image formed by the toner image forming section, the intermediate transfer section including an intermediate transfer medium having at least a surface formed of a material which is not permeated by a fixer fluid for fixing the toner image to a recording medium by softening and/or swelling a toner;

a heating section for heating the intermediate transfer medium or another toner image carrier different therefrom;

a fixer fluid applying section for applying the fixer fluid to the intermediate transfer medium or the other toner image carrier; and a transfuse section for transferring and fixing to the recording medium the toner image to which the fixer fluid has been applied, wherein the heating section and the transfuse section are disposed so that the intermediate transfer medium or the other toner image carrier is heated by the heating section during transfuse of the toner image to the recording medium by the transfuse section.

Further, according to an example embodiment of the presently disclosed technology, an image forming apparatus comprises: a toner image forming section; an intermediate transfer section including an intermediate transfer medium having at least a surface formed of a material which a fixer fluid does not permeate; a fixer fluid applying section for applying the fixer fluid to an intermediate transfer medium or another toner image carrier different therefrom; a heating section for heating the intermediate transfer medium or the other toner image carrier; and a transfuse section for transferring and fixing to the recording medium the toner image to which the fixer fluid has been applied. In the image forming apparatus, the intermediate transfer medium or the other toner image carrier is heated by the heating section at the same time when the toner image is transferred and fixed to the recording medium by the transfuse section.

In the image forming apparatus, the intermediate transfer medium or the other toner image carrier carrying the toner image is heated, that is to say, the toner image and the intermediate transfer medium or the other toner image carrier are heated by one heating section. Accordingly, it is possible to heat the toner image and the intermediate transfer medium, or the other toner image carrier to a temperature suitable for fixing the toner image to the recording medium for a short time with a small heat quantity.

In addition, since the intermediate transfer medium is heated when the toner image is transferred and fixed, a surface temperature of the toner image carrier becomes high even after the toner image has been transferred and fixed to the recording medium. Accordingly, the fixer fluid remaining on a surface of the toner image carrier, and the toner in a wet state by the fixer fluid can be dried out for a short time. As a result, a liquid component of the fixer fluid moistens a member constituting the toner image forming section so that disturbance in the toner image can be prevented from being generated. This makes it possible to obtain substantially constant images of high quality for a long period of time.

Further, according to an example embodiment of the presently disclosed technology, when the toner image is heated before or during application of the fixer fluid to the recording medium or intermediate transfer medium carrying the toner image, an entire region on the recording medium or intermediate transfer medium to which the fixer fluid is applied is directly heated. By so doing, temperatures of the toner image and recording medium or intermediate transfer medium by application of the fixer fluid is prevented from decreasing, and it is possible to promote diffusion, permeation, etc. of the just-applied fixer fluid. As a result, the toner is instantly softened and/or swelled in a large area so that the toner image is very solidly attached to the recording medium for a short time. Furthermore, it is possible to dry out the fixer fluid for a shorter time because the liquid temperature of the just-applied fixer fluid is made to rise. These advantages contribute to enhancement of throughput that indicates the number of outputted sheets per hour by the image forming apparatus.

Further, in the presently disclosed technology, it is preferable that at least a toner image forming region of the recording medium, the intermediate transfer medium or the other toner image carrier is heated by the heating section, and the fixer fluid is applied by the fixer fluid applying section to at least a toner image forming region of the recording medium, the intermediate transfer medium or the other toner image carrier.

Further, according to an example embodiment of the presently disclosed technology, at least a toner image forming region of the recording medium, the intermediate transfer medium or the other toner image carrier is heated by the heating section, and the fixer fluid is applied by the fixer fluid applying section to at least a toner image forming region of the recording medium, the intermediate transfer medium or the other toner image carrier. By so doing, it is possible to supply a heat quantity for compensating temperature decrease of the toner image and recording medium due to the application of the fixer fluid simultaneously with decrease of temperature decrease. Accordingly, the fixer fluid swiftly spreads and permeates shortly after the fixer fluid is applied so that the toner is instantly softened and swelled in a large area, and thus sufficient fixing strength can be obtained for a short time. Furthermore, the liquid temperature of the fixer fluid remaining after the toner image has been fixed, is maintained to a high temperature, so that the fixer fluid can be dried out for a short time. These advantages highly contribute to enhancement of throughput that indicates the number of outputted sheets per hour by the image forming apparatus.

Further, the presently disclosed technology provides an image forming apparatus comprising:

a toner image forming section for forming a toner image;

an intermediate transfer section serving as a toner image carrier for transferring the toner image formed by the toner image forming section, the intermediate transfer section including an intermediate transfer medium having at least a surface formed of a material which is not permeated by a fixer fluid for fixing the toner image to a recording medium by softening and/or swelling a toner;

a fixer fluid applying section for applying the fixer fluid to at least a toner image forming region of the intermediate transfer medium;

a heating section for heating at least a toner image forming region of the intermediate transfer medium; and a transfuse section for transferring and fixing to the recording medium the toner image to which the fixer fluid has been applied, wherein the heating section, the fixer fluid applying section, and the transfuse section are disposed so that the toner image forming region is heated by the heating section after the fixer fluid is applied to the toner image forming region by the fixer fluid applying section, and a region of the intermediate transfer medium, which is in contact with the recording medium, is heated by the heating section.

Further, according to an example embodiment of the presently disclosed technology, an image forming apparatus comprises: a toner image forming section; an intermediate transfer section including an intermediate transfer medium having at least a surface formed of a material which a fixer fluid does not permeate; a fixer fluid applying section for applying the fixer fluid to at least a toner image forming region of the intermediate transfer medium; a heating section for heating at least the toner image forming region of the intermediate transfer medium; and a transfuse section for transferring and fixing to a recording medium the toner image to which the fixer fluid has been applied. In the image forming apparatus, the toner image forming region is heated by the heating section after the fixer fluid is applied to the toner image forming region by the fixer fluid applying section, and a contact region of the toner image carrier with the recording medium is heated by the heating section.

In the image forming apparatus, the intermediate transfer medium carrying the toner image is heated, that is to say, the toner image and the intermediate transfer medium are heated by one heating section. Accordingly, it is possible to heat the toner image and the intermediate transfer medium to a temperature suitable for fixing the toner image to the recording medium for a short time with a small heat quantity.

Moreover, the toner image carrier which the fixer fluid does not permeate, including a transfuse position is heated. Accordingly, it is possible to selectively heat the toner softened and/or swelled by the fixer fluid, and the recording medium. Due to the foregoing, softening and/or swelling of the toner is further promoted when the toner image is transferred and fixed so that adherence (fixing strength) of the toner image to the recording medium is further enhanced, with the result that it is possible to reduce an amount of the toner remaining on the surface of the toner image carrier after the toner image is transferred and fixed. Note that the toner is softened and/or swelled by the fixer fluid and therefore, it is possible to obtain adherence between the toner image and the recording medium, which is equal to or higher than that of thermal fixing system, with a smaller heat quantity (lower heating temperature) than that of the thermal fixing system.

Further, in an example embodiment of the presently disclosed technology, it is preferable that a heating temperature of the toner image by the heating section is higher than a temperature of a glass transition point of the toner forming the toner image.

Further, according to an example embodiment of the presently disclosed technology, the toner image is heated at a higher temperature than a temperature of a glass transition point of the toner constituting the toner image. By so doing, the toner is further softened and/or swelled so that adherence among the toners and adherence of the toner to the recording medium are further enhanced. As a result, when the fixer fluid is applied to the toner, flux of the toner or the like due to application of the fixer fluid is prevented.

Further, in an example embodiment of the presently disclosed technology, it is preferable that the heating temperature of the toner image by the heating section is higher than a temperature of a softening point of the toner forming the toner image.

Further, according to an example embodiment of the presently disclosed technology, the toner image is heated at a higher temperature than a temperature of a softening point of the toner constituting the toner image. By so doing, the toner is further softened and/or swelled so that the adherence among the toners and the adherence of the toner to the recording medium are further enhanced. As a result, when the fixer fluid is applied to the toner, flux of the toner or the like due to application of the fixer fluid is more reliably prevented.

Further, in an example embodiment of the presently disclosed technology, it is preferable that the transfuse section further comprises a second toner image carrier capable of carrying the toner image on a surface thereof, the second toner image carrier having the heating section therein, and the fixer fluid applying section is provided so as to apply the fixer fluid to the toner image carried by the second toner image carrier.

Further, according to an example embodiment of the presently disclosed technology, an image forming apparatus is provided in which the transfuse section comprises a second toner image carrier, in which the heating section is disposed, and the fixer fluid applying section for applying the fixer fluid to the toner image carried by the second toner image carrier is provided.

In this image forming apparatus, the fixer fluid is applied to the toner image carried by the toner image carrier (the second toner image carrier) which is different from the intermediate transfer medium. Accordingly, the fixer fluid is hardly attached to the intermediate transfer medium, and furthermore the fixer fluid is not attached via the intermediate transfer medium to the components of the intermediate transfer section other than the intermediate transfer medium, and the components of the toner image forming section. In addition, since the toner image carried by the second toner image carrier is heated while the intermediate transfer medium is not heated, the components of the intermediate transfer section and the toner image forming section hardly have increased temperatures. These advantages contribute to attainment of stable images of high quality for a long period of time by preventing toner deterioration due to the fixer fluid and temperature increase in the course of toner image formation and toner image intermediate transfer. Moreover, the toner image is heated from inside of the second toner image carrier, and the fixer fluid is applied to the toner from outside of the second toner image carrier. By so doing, the toner is prominently softened and/or swelled so that the adherence of the toner to the recording medium is prominently enhanced, with the result that an image having high fixing strength to the recording medium is obtained.

Further, in an example embodiment of the presently disclosed technology, it is preferable that the transfuse section comprises:

a temperature detecting section for detecting a surface temperature of the second toner image carrier; and a first application amount control section for controlling an application amount of the fixer fluid applied to the toner image by the fixer fluid applying section according to a detected result from the temperature detecting section.

Further, in an example embodiment of the presently disclosed technology, it is preferable that the first application amount control section control operation of the fixer fluid applying section so as to apply a larger amount of the fixer fluid when the surface temperature of the second toner image carrier, detected by the temperature detecting section, is lower than the first predetermined temperature, compared to the application amount at a time when the surface temperature of the second toner image carrier is equal to or higher than the first predetermined temperature.

Further, according to an example embodiment of the presently disclosed technology, the transfuse section comprises a temperature detecting section for detecting a surface temperature of the second toner image carrier; and a first application amount control section for controlling an application amount of the fixer fluid applied to the toner image by the fixer fluid applying section according to a detected result from the temperature detecting section. Due to the foregoing, even when the surface temperature of the second toner image carrier changes, a fixed image having sufficient fixing strength to the recording medium is obtained. For instance, even during a warm-up period that the surface temperature of the second toner image carrier is lower than a first predetermined temperature (set temperature), a fixed image having the same fixing strength as that at the first predetermined temperature (set temperature) is obtained by using a larger application amount of the fixer fluid than that at the set temperature. Furthermore, when the surface temperature of the toner image carrier is higher than the first predetermined temperature, it is possible to reduce the consumption of the fixer fluid by reducing the application amount of the fixer fluid, or stopping the application.

Further, in an example embodiment of the presently disclosed technology, it is preferable that the transfuse section further comprises:

a pressure member in pressure contact with the second toner image carrier via the recording medium;

a pressure member temperature detecting section for detecting a surface temperature of the pressure member; and a second application amount control section for controlling the application amount of the fixer fluid applied to the toner image by the fixer fluid applying section according to a detected result from the pressure member temperature detecting section, wherein the second application amount control section controls the operation of the fixer fluid applying section so as to apply a larger amount of the fixer fluid when the surface temperature of the pressure member, detected by the pressure member temperature detecting section, is lower than a second predetermined temperature, compared to the application amount at a time when the surface temperature of the pressure member is equal to or higher than the second predetermined temperature.

Further, according to an example embodiment of the presently disclosed technology, the transfuse section comprises pressure member in pressure contact with a surface of the second toner image carrier; a pressure member temperature detecting section for detecting a surface temperature of the pressure member; and a second application amount control section for controlling the application amount of the fixer fluid to the toner image according to a detected result from the pressure member temperature detecting section. In this case, the second application amount control section sets the fixer fluid applying section so as to increase the application amount of the fixer fluid when the surface temperature of the pressure member is lower than a second predetermined temperature, compared to the application amount at the time when the surface temperature of the pressure member is equal to or higher than the second predetermined temperature. Due to the foregoing, a fixed image having sufficient fixing strength to the recording medium is obtained regardless of the surface temperature of the pressure member. For instance, when the surface temperature of the pressure member is lower than the second predetermined temperature, a fixed image having the same fixing strength as that at the second predetermined temperature is obtained by increasing the application amount of the fixer fluid. Furthermore, when the surface temperature of the pressure member is higher than the second predetermined temperature, it is possible to reduce the consumption of the fixer fluid by reducing the application amount of the fixer fluid, or stopping the application.

Further, in an example embodiment of the presently disclosed technology, it is preferable that the fixer fluid applying section comprises:

a toner amount detecting section for detecting a toner amount on the toner image; and a fixer fluid application amount control section capable of partially changing the application amount of the fixer fluid depending on a control signal from the toner amount detecting section, wherein the fixer fluid is applied to only the toner amount image having the toner amount that is equal to or more than a predetermined amount.

Further, according to an example embodiment of the presently disclosed technology, in the image forming apparatus, the fixer fluid applying section comprises a toner amount detecting section for detecting a toner amount on the toner image; and a fixer fluid application amount control section for changing the application amount of the fixer fluid based on a control signal from the toner amount detecting section. In this case, it is possible to further reduce the consumption of the fixer fluid by applying the fixer fluid to only the toner image having a larger toner amount than a set amount.

That is to say, the toner is powder formed of resin having low heat conductivity and therefore, on a portion having a larger amount of attached toner and a thicker toner layer, the temperature of the toner more hardly increases at a position further away from the transfuse section. The thickness of the toner image itself is approximately a few μm to a few dozens of μm, but in the image forming apparatus in which the toner image is instantly transferred and fixed, temperature distribution, that is, temperature variation is generated even by a slight difference of the toner image in thickness such as a few μm, which greatly affects the fixing strength of the toner image to the recording medium. Accordingly, on the portion having a large amount of attached toner, the toner may not be sufficiently softened so that adherence of the toner to the recording medium may be decreased. With the above described configuration, the application of the fixer fluid compensates for this adherence decrease so that a fixed image having sufficient fixing strength to the recording medium is obtained. On the other hand, on a portion having a small amount of attached toner, the entire toner layer has a temperature sufficient to soften the toner so that the fixing strength to the Recording medium can be secured without applying the fixer fluid.

Further, on the portion having a small amount of attached toner, a small amount of the toners are attached to each other so that the toner and the recording medium are mainly attached to each other and therefore, the toner is hardly separated from the recording medium even when the fixed image is folded. In contrast, on the portion having a large amount of attached toner, the toners are mainly attached to each other when the toner image is fixed to the recording medium and therefore, the toner may be separated from the recording medium in a case where external stress is given such that the fixed image is folded. Accordingly, the adherence of the toner to the recording medium needs to be enhanced on the portion having a large amount of attached toner. In particular, by applying the fixer fluid so as to permeate the portion having a large amount of attached toner from a contact face between the toner and the recording medium, it is possible to remarkably increase the adherence between the toner image and the recording medium. This makes it possible to obtain a fixed image from which the toner image is not separated even by external stress such that the recording medium is folded.

Further, in an example embodiment of the presently disclosed technology, it is preferable that the image forming apparatus further comprises a fixer fluid heat retaining section for heating and keeping warm the fixer fluid.

Further, according to an example embodiment of the presently disclosed technology, the image forming apparatus is provided with a fixer fluid heat retaining section for heating and keeping warm the fixer fluid. Due to the foregoing, the temperature of the toner is prevented from decreasing when the fixer fluid is applied thereto, and moreover the toner is softened due to the fixer fluid and heat, with the result that the toner can be led to a softened state which is best suited to be transferred and fixed.

Further, in an example embodiment of the presently disclosed technology, it is preferable that the fixer fluid contains an adhesive agent for increasing the adherence of the toner image to the recording medium.

Further, according to an example embodiment of the presently disclosed technology, the fixer fluid contains an adhesive agent for increasing the adherence of the toner image to the recording medium. Due to the foregoing, the adherence between the toner and the recording medium is given by not only softened and/or swelled toner, but also the adhesive agent. Accordingly, the adherence of the toner image to the recording medium, and further the fixing strength can be enhanced.

Further, in an example embodiment of the presently disclosed technology, it is preferable that the toner contains polyester as a binder resin, and a wax component of which a temperature of a glass transition point is lower than that of polyester.

Further, according to an example embodiment of the presently disclosed technology, it is preferable to use the toner containing polyester as a binder resin, and further a wax component of which a temperature of a glass transition point is lower than that of polyester.

That is to say, polyester is more easily softened and/or swelled by an organic solvent than the other resin, and in the softened and/or swelled state, polyester is transparent. Accordingly, when a few types of color toner images formed of the toner containing polyester are combined and fixed to the recording medium by the fixer fluid and heat, bright coloration is obtained by subtractive color mixture.

Moreover, the wax component of which a temperature of a glass transition point is lower than that of polyester as a binder resin is easily softened by heat. Accordingly, even at a lower temperature than the temperature of the glass transition point of the toner, the adherence among the toners, and the adherence between the toner and the toner image carrier, recording medium, or the like are enhanced. Consequently, preheating makes it possible to restrain the toner from flowing, being agglomerated and the like when the fixer fluid is applied thereto. Furthermore, softening of the wax component makes it easy for the fixer fluid to permeate from a portion where the wax component exists to an interior portion of toner particles. Accordingly, an entire toner is softened and/or swelled for a short time when the fixer fluid is applied thereto so that the fixing strength of the toner image to the recording medium is enhanced.

By thus using the toner having the constitution, it is possible to obtain a fixed image having the sufficient fixing strength and coloration.

Further, in an example embodiment of the presently disclosed technology, it is preferable that a volume average particle diameter of the toner is 2 μm or larger and 7 μm or smaller.

Further, according to an example embodiment of the presently disclosed technology, by using the toner having a toner particle of which a volume average particle diameter is 2 to 7 μm, it is possible to obtain a fixed image of high quality having high fixing strength to the recording medium, and favorable coloration.

Further, in an example embodiment of the presently disclosed technology, it is preferable that the fixer fluid further contains a release agent.

Further, according to an example embodiment of the presently disclosed technology, the fixer fluid is made to contain a release agent. This makes it possible to further prevent offset phenomenon that the toner image is attached to a member to be applied by the fixer fluid when the fixer fluid is applied to the toner image in contact therewith, the toner image being on the recording medium, the intermediate transfer medium, or the other toner image carrier.

BRIEF DESCRIPTION OF THE DRAWINGS

Other and further objects, features, and advantages of the presently disclosed technology will be more explicit from the following detailed description taken with reference to the drawings wherein.

DETAILED DESCRIPTION OF THE PREFERRED EMBODIMENTS

Figure 1:
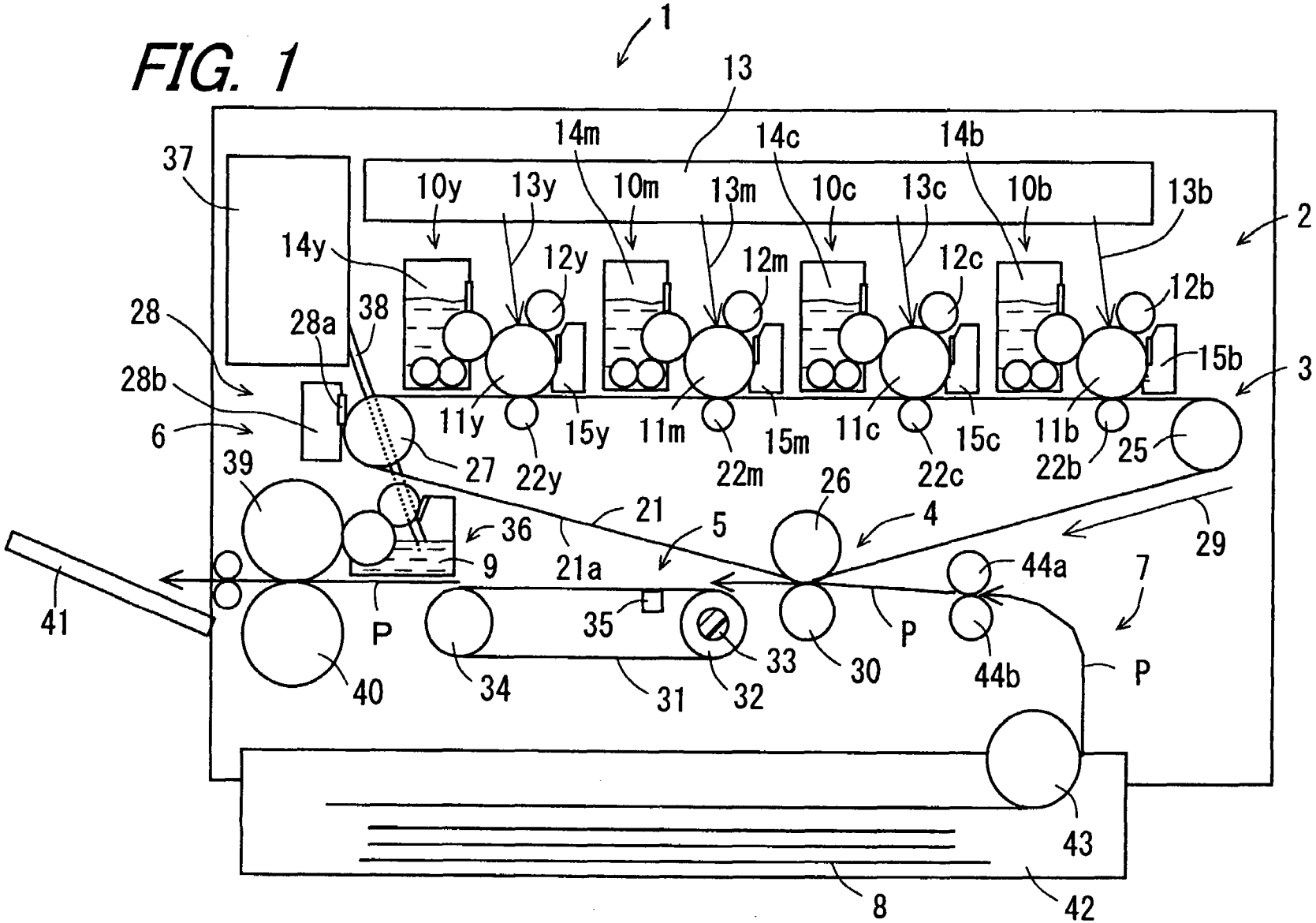
FIG. 1 is a sectional view schematically showing a configuration of an image forming apparatus according to a first embodiment of the presently disclosed technology.

Now referring to the drawings, preferred embodiments of the presently disclosed technology are described below.

Figure 2:
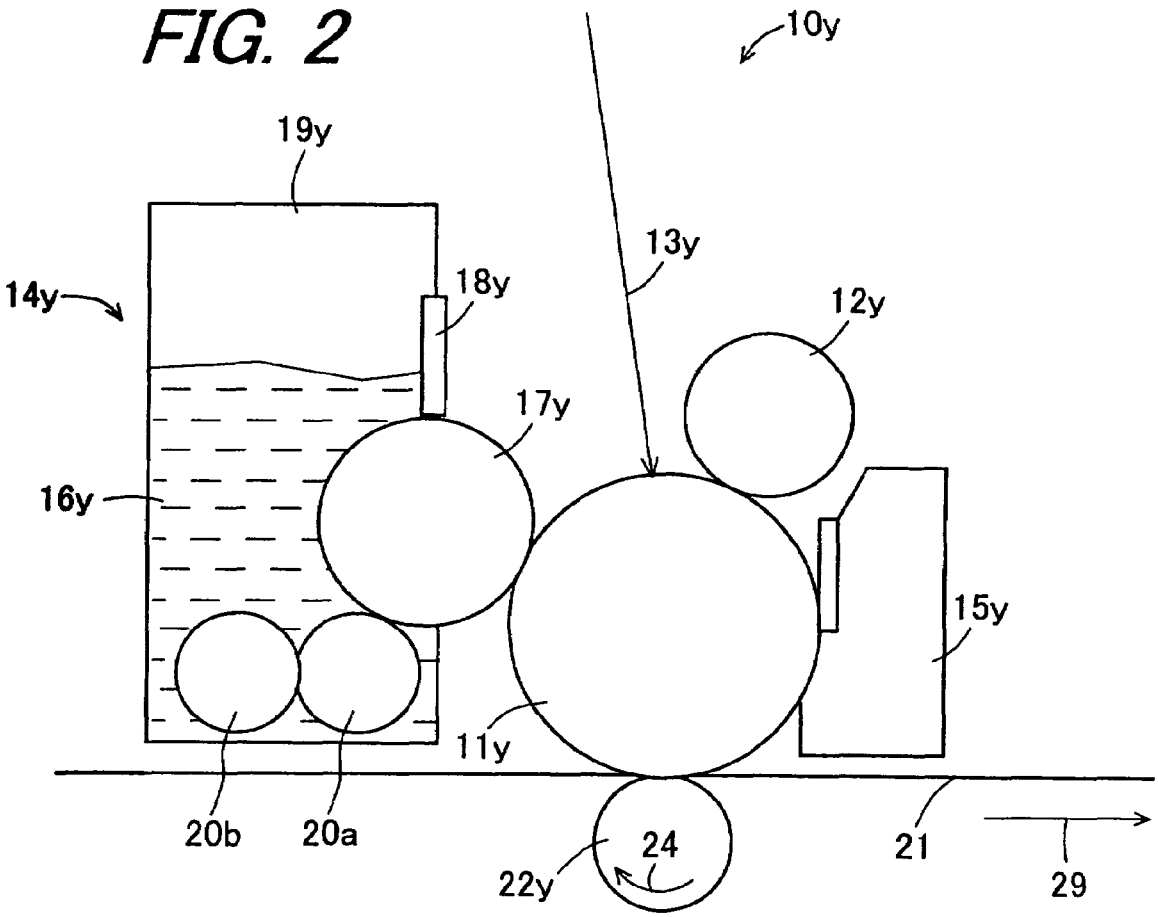
FIG. 2 is an enlarged sectional view showing a configuration of a substantial part of the image forming apparatus shown in FIG. 1.
Figure 3:
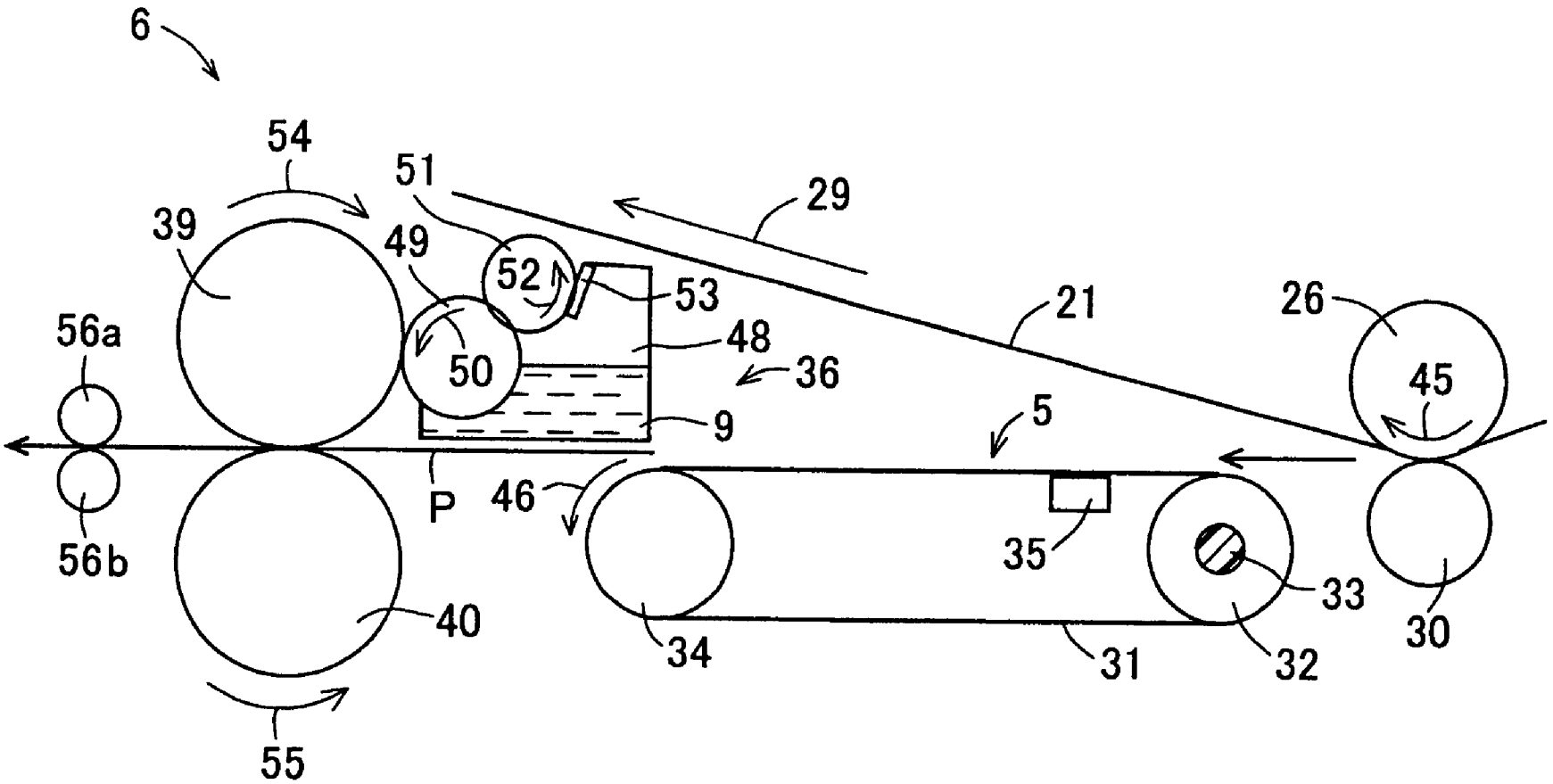
FIG. 3 is an enlarged sectional view showing a configuration of the substantial part of the image forming apparatus shown in FIG. 1.
Figure 4:
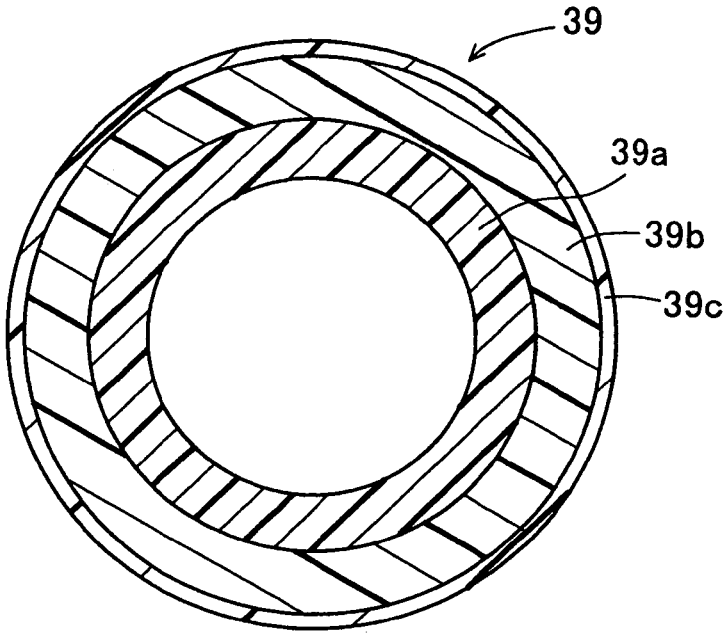
FIG. 4 is a sectional view schematically showing a configuration of a fixing roller used in the image forming apparatus shown in FIG. 1.

FIG. 1 is a sectional view schematically showing a configuration of an image forming apparatus 1 according to a first example embodiment of the presently disclosed technology. FIG. 2 is an enlarged sectional view showing a configuration of a substantial part (a toner image forming section 2 which will be described hereinbelow) of the image forming apparatus 1 shown in FIG. 1. FIG. 3 is an enlarged sectional view showing a configuration of the substantial part (a secondary transfer section 4, a heating section 5, and a fixer fluid applying section 6, which will be described hereinbelow) of the image forming apparatus shown 1 in FIG. 1. FIG. 4 is a sectional view schematically showing a configuration of a fixing roller 39.

The image forming apparatus 1 comprises a toner image forming section 2, an intermediate transfer section 3, a secondary transfer section 4, a heating section 5, a fixer fluid applying section 6, and a recording medium supplying section 7.

The toner image forming section 2 comprises image forming units 10*y*, 10*m*, 10*c* and 10*b*, which form electrostatic latent images corresponding to image information on respective color components and develop the electrostatic latent images so as to form toner images of respective colors. In other words, the image forming unit 10*y* forms a toner image corresponding to yellow image information. The image forming unit 10*m* forms a toner image corresponding to magenta image information. The image forming unit 10*c* forms a toner image corresponding to cyan image information. The image forming unit 10*b* forms a toner image corresponding to black image information. The image forming units 10*y*, 10*m*, 10*c* and 10*b* are arranged in a row in this order from an upstream side in which an intermediate transfer belt 21 moves (in a sub-scanning direction), that is to say, in an arrow sign 29 direction.

The image forming unit 10*y* comprises a photoreceptor drum 11*y*, a charging roller 12*y*, a light scanning unit 13, a developing apparatus 14*y*, and a drum cleaner 15*y*.

The photoreceptor drum 11*y* is supported by a driving section (not shown) so as to be capable of rotating about a shaft line thereof. The photoreceptor drum 11*y* comprises a cylindrical, columnar, or thin film sheet-like conductive base which is preferably cylindrical, and a photosensitive layer formed on a surface of the conductive base. The photoreceptor drum 11*y* may be composed of materials which are commonly used in this field. For instance, the photoreceptor drum 11*y* may be a photoreceptor drum having a diameter of 30 mm, which comprises an aluminum tube serving as a conductive base and an organic photosensitive layer on a surface of the aluminum tube and which is connected to ground potential (GND). The organic photosensitive layer is composed of laminated layers of a charge generating layer containing a charge generating substance and a charge transporting layer containing a charge transporting substance. The charge generating substance and the charge transporting substance may be in a single layer of the organic photosensitive layer. The organic photosensitive layer has a layer thickness of 20 μm, for instance. In addition, an undercoat layer may be provided between the organic photosensitive layer and the photoreceptor drum. Furthermore, a protective layer may be provided on a surface of the organic photosensitive layer. In the example embodiment, the photoreceptor drum rotates in a clockwise direction at a peripheral velocity of 100 mm/s, for instance.

The charging roller 12*y* charges a surface of the photoreceptor drum 11*y* to predetermined polarity and potential. The charging roller 12*y* may be replaced by a brush charging device, a charger charging device, a corona charging device such as scorotoron.

The light scanning unit 13 irradiates the surface of the photoreceptor drum 11*y* in a charged state with a laser light 13*y* corresponding to the yellow image information so as to form the electrostatic latent image corresponding to the yellow image information. A semiconductor laser or the like is used as a light source of the laser light 13*y*.

The developing apparatus 14*y* comprises a developing roller 17*y*, a developing blade 18*y*, a toner storing container 19*y*, and stirring rollers 20*a* and 20*b*. The developing roller

17*y* pressure-contacts the surface of the photoreceptor drum 11*y*, and includes a fixed magnetic pole (not shown). The developing roller 17*y* is capable of rotating about a shaft line thereof so as to supply a yellow toner 16*y* to the electrostatic latent image on the surface of the photoreceptor drum 11*y*. The developing blade 18*y* contacts a surface of the developing roller 17*y*, for equalizing (layer regulating) a yellow toner layer on the surface of the developing roller 17*y*. The toner storing container 19*y* stores the yellow toner 16*y*. The stirring rollers 20*a* and 20*b* are provided in pressure-contact with each other inside the toner storing container 19*y*. The stirring rollers 20*a* and 20*b* are capable of rotating about shaft lines thereof. The stirring roller 20*a* pressure-contacts the surface of the developing roller 17*y* and supplies the yellow toner 16*y* to the surface of the developing roller 17*y*. At a developing nip portion on which the developing roller 17*y* pressure-contacts (contacts) the photoreceptor drum 11*y*, the developing roller 17*y* rotates in the same direction as the photoreceptor cream 11*y* does. Accordingly, a rotating direction of the developing roller 17*y* about a shaft line thereof is opposite to a rotating direction of the photoreceptor drum 11*y* about a shaft line thereof. In this embodiment, a peripheral velocity of the developing roller 17*y* is, for instance, 150 mm/s which is 1.5 times larger than that of the photoreceptor drum 11*y*. The yellow toner 16*y* in the toner storing container 19*y* is supplied by the stirring rollers 20*a* and 20*b* to the surface of the developing roller 17*y* on which the developing blade 18*y* equalizes a layer thickness of the supplied yellow toner 16*y*. Subsequently, the yellow toner 16*y* is supplied on a substantially elective basis to the electrostatic latent image on the surface of the photoreceptor drum 11*y* by use of potential difference or the like so as to form the toner image corresponding to the yellow image information. Note that in the example embodiment is used a two-component developer in which the yellow toner 16*y* and a magnetic carrier are mixed. In the example embodiment, the photoreceptor drum 11*y* pressure-contacts the developing roller 17*y* which pressure-contacts the developing blade 18*y* and the stirring roller 20*a*. However, these components are not limited to the above configuration, and may be provided away from each other with slight spaces therebetween.

After the yellow toner image on the surface of the photoreceptor drum 11*y* is transferred to the intermediate transfer belt 21, a remaining yellow toner on the surface of the photoreceptor drum 11*y* is removed and collected by the drum cleaner 15*y* as will be described hereinbelow.

By means of the image forming unit 10*y*, the surface of the photoreceptor drum 11*y* is firstly charged by the charging roller 12*y* to, for instance, −600 V while the photoreceptor drum 11*y* is made to rotate about a shaft line thereof. Next, the surface of the photoreceptor drum 11*y* in the charged state is irradiated with a signal light from the light scanning unit 13, the signal light being corresponding to the yellow image information, so as to form the electrostatic latent image having an exposure potential of −70 V corresponding to the yellow image information. Subsequently, the yellow toner layer carried by the surface of the developing roller 17*y* contacts the surface of the photoreceptor drum 11*y*. Direct voltage of −240 V has been applied to the developing roller 17*y* as a developing potential. Due to the potential difference, the yellow toner 16*y* is attached to the electrostatic latent image and the development is thus performed, so that a yellow toner image is formed on the surface of the photoreceptor drum 11*y*. This yellow toner image pressure-contacts the surface of the photoreceptor drum 11*y*, and the intermediate transfer of the yellow toner image is performed onto the intermediate transfer belt 21 driven in an arrow sign 29 direction as will be described hereinbelow. The yellow toner 16*y* remaining on the surface of the photoreceptor drum 11*y* is removed and collected by the drum cleaner 16*y*. Afterward, the same operation for forming the yellow toner image is repeatedly carried out.

The image forming units 10*m*, 10*c* and 10*b* have the same configurations except that the image forming unit 10*m* employs a magenta toner 16*m*, that the image forming unit 10*c* employs a cyan toner 16*c*, and that the image forming unit 10*b* employs a black toner 16*b*. Accordingly, the image forming units 10*m*, 10*c* and 10*b* are denoted by the same reference numerals. Furthermore, an end of each reference numeral is denoted by "m" which shows magenta, "c" which shows cyan, and "b" which shows black, so that description thereof will be omitted.

Note that the toners of each color 16*y*, 16*m*, 16*c* and 16*b* contain a binder resin, a colorant, and a release agent, and have the same composition except that a type of the colorant is different. The binder resin is not particularly limited as long as the resin is softened or swelled by an after-mentioned fixer fluid 9. The binder resin includes polystyrene, homopolymer of styrene substation, styrene copolymer, polyvinyl chloride, polyvinyl acetate, polyethylene, polypropylene, polyester, and polyurethane, for instance. The binder resin can be used alone or in combination. Among such a binder resin, for use in a color toner, it is preferable to use a binder resin having a softening point of 100 to 150° C. and a glass transition point of 50 to 80° C. in terms of preservability, durability, after-mentioned control for softening or swelling due to the fixer fluid 9, and the like. Polyester is particularly preferable. It is easy to soften and/or swell polyester by an easily available organic solvent, and in softened or swelled state, polyester becomes transparent. Accordingly, when a multicolored toner image having toner images of yellow, magenta, cyan, and black combined over thereon by the fixer fluid, polyester itself which is a binder resin becomes transparent so that sufficient coloration can be obtained by subtractive color mixture. Moreover, even on use of resin having a softening point of a higher temperature and higher hardness than those of a binder resin used in a toner for heat fixing, that is to say, resin having a larger molecular weight and higher hardness, it is possible to conduct fixing due to the fixer fluid 9. When resin having a softening point of a high temperature and high hardness is used, it is possible to prevent deterioration due to loads at developing occasion so that less deteriorated images can be obtained for a long period of time.

As the colorant, it is possible to use toner pigment and dye used in the conventional image forming art of electrophotographic system. However, in order to prevent blur due to the fixer fluid 9, a pigment not dissolved in the fixer fluid 9 is preferable while dye such as nigrosine dye is not preferable. To be specific, the pigments include organic pigments such as azo pigment, benzimidazolone pigment, quinacridone pigment, phthalocyanine pigment, isoindolinone pigment, isoindoline pigment, dioxazine pigment, anthraquinone pigment, perylene pigment, perynone pigment, thioindigo pigment, quinophthalone pigment, and metal complex pigment; inorganic pigments such as carbon black, titanium oxide, molybdenum red, chrome yellow, titanium yellow, chrome oxide, and Berlin blue; and metal powders such as aluminum powder. The pigment can be used alone or in combination.

As the release agent, various wax can be used. Any wax can be used without particular limitation as long as the wax is softened or swelled by the fixer fluid 9. To be specific, the wax includes polyethylene wax, polypropylene wax, and paraffin wax, for instance.

The toner can contain, other than the binder resin, colorant and release agent, one or two or more additives for general use in toner, such as charge control agent, fluidity improving agent, fixing promoting agent, and conductive agent.

A volume average particle diameter of the toner is not particularly limited, but 2 to 7 μm is preferable. When such a toner having a small particle diameter is used, the toner has a larger surface area per unit area thereof so as to have an increased contact area with the fixer fluid 9 so that it becomes easy to carry out the fixing. This rakes it possible to reduce usage of the fixer fluid 9 and moreover, take a short time to fix the toner image onto a recording medium and dry out the toner image after the fixing. Further, in a case where the volume average particle diameter of the toner is appropriately small, a covering rate over a recording medium 8 becomes higher, so that high image quality can be achieved with a small amount of attached toner and that toner consumption can be reduced and thus, consumption of the fixer fluid 9 can be further reduced.

In a case where the volume average particle diameter of the toner is smaller than 2 μm, the toner has lower fluidity. In this case, toner supply, stirring, and charging become insufficient at the developing occasion so that lack of toner amount, increase of toner having a reverse polarity, and the like may be caused, with the result that it may not be possible to obtain an image of high quality. On the other hand, in a case where the volume average particle diameter of the toner is larger than 7 μm, the increased number of toner particles are hardly softened and/or swelled to the center of toner particles thereof with large particle diameters, so that fixing property of the image onto the recording medium decreases and that coloration of the image is deteriorated. Particularly in a case of the fixing onto an OHP sheet, a darker image will be obtained.

The temperatures of softening point and glass transition point of the toner itself are not particularly limited, but the temperature of the softening point is preferably 100 to 130° C. and the temperature of the glass transition point is preferably of 50 to 80° C. Such a toner having a softening point of a high temperature is preferable for enhancing the durability against the loads at the developing occasion, but the toner is not sufficiently fixed and coloration of the toner is not sufficient in the heat fixing system. However, in the example embodiment of the presently disclosed technology , the toner is chemically softened and/swelled by use of the fixer fluid 9 and therefore, the fixing property and coloration are sufficient so that the image of high quality can be obtained. Note that the toner may show a plurality of temperatures of softening points and glass transition points in a case where the toner contains a plurality of binder resins. In this case, the toner softening point indicates a temperature of the lowest softening point among a plurality of the softening points, and the glass transition point indicates a temperature of the lowest glass transition point among a plurality of the glass transition points.

The toner can be manufactured according to a heretofore known method. The heretofore known method includes, for instance, a method in which the release agent, colorant and the like are dispersed and milled in the binder resin, and a method in which the release agent, colorant and the like are dispersed in a monomer solution of the binder resin and then, the monomer of the binder resin is copolymerized. In both methods, it is preferable to adjust the toner so that the toner has a shape which is more irregular than a sphere, in order to increase the surface area of the toner. This enables the toner to contact the fixer fluid 9 more easily and therefore, it is possible to reduce the usage of the fixer fluid 9 and take a short time to fix and dry out the toner image.

The toners of each color 16*y*, 16*m*, 16*c* and 16*b* may be used as they are as one-component developer, or may be used in mixture with carrier as two-component developer.

The toners of each color 16*y*, 16*m*, 16*c* and 16*b* used in the example embodiment have the same configuration shown as follows, except the pigment. The toner has a glass transition point of 60° C., a softening point of 120° C., and a volume average particle diameter of 6 μm. This toner is a negatively charged insulating nonmagnetic toner. In order to obtain an image density that a reflection density measurement thereof, measured by a product 310 manufactured by X-Rite Co., is 1.4 by use of this toner, the toner amount needs to be 5 g/m$^2$. This toner contains polyester (a binder resin) having a glass transition point of 60° C. and a softening point of 120° C., low-molecular polyethylene wax (release agent) having a glass transition point of 50° C. and a softening point of 70° C., and pigments of each color. A content of the wax is 7% by weight of the total toner amount. A content of the pigment is 12% by weight of the total toner amount. And the rest of the total toner amount is polyester which is the binder resin. The low-molecular polyethylene wax contained in this toner is wax of which temperatures of glass transition point and softening point are lower than those of polyester as a binder resin. Such wax increases adherence among the toners, and adherence between the toner and the intermediate transfer belt 21 or the recording medium 8 even under temperature which is lower than the temperature of the glass transition point of the binder resin. Accordingly, it is possible to restrain generation of running toner, toner agglomeration, or the like due to the fixer fluid 9 when the fixer fluid 9 in a liquid form is applied. Furthermore, when the wax in the toner is softened, the fixer fluid 9 permeates the toner more easily from a part where the wax exists. Accordingly, when the fixer fluid 9 is applied, the entire toner can be softened and/or swelled for a short time, and when the toner is transferred to the recording medium 8, sufficient fixing strength can be obtained and moreover the coloration due to combination of the toner images becomes sufficient.

The intermediate transfer section 3 comprises an intermediate transfer belt 21, intermediate transfer rollers 22*y*, 22*m*, 22*c* and 22*b*, support rollers 25, 26 and 27, and a belt cleaner 28.

The intermediate transfer belt 21 is a belt having no end, which is stretched over the support rollers 25, 26 and 27 so as to form a loop travel path. The intermediate transfer belt 21 is circulated in the arrow sign 29 direction at substantially the same velocity as those of the photoreceptor drums 11*y*, 11*m*, 11*c* and 11*b*. As the intermediate transfer belt 21, for instance, a surface of a polyimide film having a thickness of 100 μm is covered with a coating layer formed of fluorine resin composition containing PTFE (polyzetrafluoroethylene) and PFA (copolymer of tetrafluoroethylene and perfluoroalkyl vinyl ether) at proportion of 8 to 2 (weight ratio). In the polyimide film and coating layer, conductive materials such as furnace black, thermal black, channel black, and graphite carbon are mixed. A surface of the coating layer is a toner image carrying face 21*a*. Note that materials of the intermediate transfer belt 21 are not limited to the above-mentioned materials, but any material which the fixer fluid 9 does not permeate can be used without particular limitation. For instance, a film such as polycarbonate and fluorocarbon rubber, on which conducting property is given, may be covered with the coating layer composed of PTFE and/or PFA.

The toner image carrying face 21*a* of the intermediate transfer belt 21 pressure-contacts the photoreceptor drums 11*y*, 11*m*, 11*c* and 11*b* in this order. A pressure-contact region of the intermediate transfer belt 21 with the photoreceptor drums 11$y$, 11$m$, 11$c$ and 11$b$ is an intermediate transfer position of the toner image of each color component. The intermediate transfer rollers 22$y$, 22$m$, 22$c$ and 22$b$ are disposed at positions opposite to the photoreceptor drums 11$y$, 11$m$, 11$c$ and 11$b$ across the intermediate transfer belt 21.

The intermediate transfer rollers 22$y$, 22$m$, 22$c$ and 22$b$ pressure-contact an opposite face of the toner image carrying face 21$a$ on the intermediate transfer belt 21. The intermediate transfer rollers 22$y$, 22$m$, 22$c$ and 22$b$ can rotate about shaft lines thereof by a driving section (not shown) . The intermediate transfer rollers 22$y$, 22$m$, 22$c$ and 22$b$ comprise metallic shaft bodies and conductive layers covered on surfaces of the metallic shafts, for instance. The shaft body is formed of metal such as stainless steel. A diameter of the shaft body is not particularly limited, but preferably 8 to 10 mm. The conductive layer is formed of conductive elastic materials. As the conductive elastic materials, materials which are commonly used in this field can be used. For instance, the conductive elastic materials include EPDM, foamed EPOM, urethane foam, and the like containing conductivity control agent such as carbon black. Due to the conductive layer, high voltage is uniformly applied to the intermediate transfer belt 21.

An intermediate transfer bias having a polarity opposite to a charge polarity of the toner is applied to the intermediate transfer rollers 22$y$, 22$m$, 22$c$ and 22$b$ by constant voltage control in order to transfer the toner images formed on the surfaces of the photoreceptor drums 11$y$, 11$m$, 11$c$ and 11$b$ onto the intermediate transfer belt 21. The toner images of respective color components of yellow, magenta, cyan, and black formed on the photoreceptor drums 11$y$, 11$m$, 11$c$ and 11$b$ are sequentially combined and transferred onto the toner image transfer face 21$a$ of the intermediate transfer belt 21 so as to form a multicolored toner image. However, in a case where only image Information on a part of color components of yellow, magenta, cyan, and black is inputted, only an image forming unit corresponding to the color component in the inputted image information creates a toner image.

For the support rollers 25, 26 and 27, for instance, cylindrical bodies formed of aluminum having diameters of 30 mm and thicknesses of 1 mm are used. The support roller 26 in pressure contact with an after-described secondary transfer roller 30 via the intermediate transfer belt 21 electrically connects to ground.

The belt cleaner 28 is a member for removing remaining toner on the toner image transfer face 21$a$ after the toner image on the toner image transfer face 21$a$ of the intermediate transfer belt 21 has been transferred to the recording medium 8 by an after-described secondary transfer section 4. The belt cleaner 28 comprises a cleaning blade 28$a$ and a toner storing container 28$b$. The belt cleaner 28 faces the support roller 27 across the intermediate transfer belt 21, and pressure-contacts the toner image transfer face 21$a$ of the intermediate transfer belt 2 by a pressure section (not shown) . The belt cleaner 28 scrubs off the remaining toner on the toner image transfer face 21$a$. The toner storing container 28$b$ stores the toner scrubbed off by the cleaning blade 28$a$. As the cleaning blade 28$a$, for instance, a blade formed of elastic rubber materials (such as urethane rubber) can be used.

By means of the intermediate transfer section 3, the toner images of respective colors formed on the photoreceptor drums 11$y$, 11$m$, 11$c$ and 11$b$ are combined and transferred onto the toner image transfer face 21$a$ of the intermediate transfer face 21$a$ at predetermined positions so as to form a toner image. After this toner image is transferred to the recording medium 8 by the secondary transfer section 4, the remaining toner, offset toner, paper dust, and the like on the toner image transfer face 21$a$ are removed by the belt cleaner 28, and a toner image is transferred to the toner image transfer face 21$a$ again.

The secondary transfer section 4 comprises a secondary transfer roller 30 which pressure-contacts the support roller 26 via the intermediate transfer belt 21 and which can rotate about a shaft line thereof. As the secondary transfer roller 30, for instance, an urethane rubber layer having a thickness of 4 mm is provided on an outer periphery of a cored bar having a diameter of 10 mm. In the urethane rubber layer, conductive agents such as carbon are mixed in order to give the conducting property. Moreover, the secondary transfer roller 30 is pressed on the support roller 26 at line pressure of 1 N/cm, that is to say, at pressure acting on a line. When the toner image on the intermediate transfer belt 21 is transferred to the recording medium 8 by the secondary transfer roller 30, for instance; voltage of +1 kV is applied to the cored bar of the secondary transfer roller 30.

By means of the secondary transfer section 4, the recording medium 8 is fed from an after-described recording medium supplying section 7 in synchronization with conveyance of the intermediate transfer belt 21 which carries the multicolored toner image, to a pressure-contact portion between the secondary transfer roller 30 and the support roller 26 And thus, the multicolored toner image on the intermediate transfer belt 21 is transferred to the surface of the recording medium a by pressure. The recording medium 8 on which the multicolored toner image has been transferred is conveyed to the heating section 5.

The heating section 5 comprises a conveying belt 31 for conveying the recording medium 8 on which the multicolored toner image has been transferred, to an after-described fixer fluid applying section 6; a heating roller 32; a tension roller 34; and a temperature sensor 35.

The conveying belt 31 is a belt having no end, which is stretched between the heating roller 32 and the tension roller 34 so as to form a loop travel path. The conveying belt 31 is circulated in an arrow sign 46 direction. The conveying belt 31 may be composed of a polyimide film having a thickness of 100 μm, in which the conductive agent is mixed so as to give the conducting property; and a surface layer formed of PTFE having a thickness of 10 μm, which is provided on at least one surface of the polyimide film, for instance.

The heating roller 32 can rotate about a shaft line thereof by a driving section (not shown). The heating roller 32 is a roller-shaped member having a heating section 33 therein. In this case, the heating roller 32 has a function for heating the conveying belt 31 and a function as a driving roller. As the heating roller 32, for instance, a hollow roll formed of metals such as aluminum can be used. As the heating section 33, a halogen lamp or the like is used. By operation of this heating roller 32, the conveying belt 31 and further the toner image carried on the surface of the conveying belt 31 are heated preferably to temperature which is a slightly lower than the temperature of the glass transition point of the toner constituting the toner image. For instance, when the toner has a temperature of a glass transition point of 60° C., the temperature is preferably 55 to 58° C., and 56° C. is particularly preferable. Note that in order to heat the toner image to 55 to 58° C., it is favorable to keep surface temperature of the conveying belt 31 to 70° C.

The tension roller 34 gives predetermined tension to the conveying belt 31 so that the conveying belt 31 does not sag. The tension roller 34 comprises metallic shaft body, and a coating layer formed on a surface of the metallic shaft body, for instance. Further, the tension roller 34 may be composed of only the metallic shaft body. For instance, stainless steel is used for materials of the metallic shaft body while fluorocarbon rubber is used for materials of the coating layer. In addition, the tension roller 34 may be a hollow roller.

The temperature sensor 35 contacts or comes close to the conveying belt 31 in order to detect the surface temperature of the conveying belt 31. A detected result due to the temperature sensor 35 is sent to CPU (not shown) for controlling entire operation of the image forming apparatus 1. On the basis of the detected result, the CPU sends a control signal to a power source (not shown) for applying voltage to the heater 33 so as to control calorific value of the heater 33.

In the example embodiment, the surface temperature of the conveying belt 31 is kept to 70° C. By so doing, the temperature of the toner image on the recording medium 8 placed on the conveying belt 31 is set to be lower than the temperature of the glass transition point (60° C.) of the toner. However, the temperature of the toner image on the recording medium 8 is not limited to the above value, but may be set to be higher than the temperature of the glass transition point (60° C.) by keeping the surface temperature of the conveying belt 31 to 80° C. This makes it possible to soften the toner to some extent before the fixer fluid 9 is applied, and increase the adherence among the toners, and adherence between the toner and the recording medium 8, so as to prevent the toner from moving, being agglomerated, and the like by the fixer fluid 9 when the fixer fluid 9 is applied. In addition, the temperature of the toner image on the recording medium 8 may be set to be higher than the temperature of the softening point (120° C.) by keeping the surface temperature of the conveying belt 31 to 140° C. This makes it possible to sufficiently soften the toner, and further increase the adherence among the toners, and adherence between the toner and the recording medium 8, so as to further prevent the toner from moving, being agglomerated, and the like by the fixer fluid 9 when the fixer fluid 9 is applied. Note that in the examples cited here is used a toner having a glass transition point of 60° C. and a softening point of 120° C. It is possible to appropriately change the surface temperature of the conveying belt 31 according to the temperatures of the glass transition point and softening point of the toner.

By means of the heating section 5, the recording medium 8 carrying an unfixed toner image is placed on the conveying belt 31 and conveyed in an arrow sign 46 direction while heated by the heating roller 32, and then fed to the fixer fluid applying section 6.

In the example embodiment, the heating roller 32 having the heater 33 therein is used as the heating section 5. However, the heating section 5 is not limited to this configuration. It is possible to use a heating section of contact heating system, such as a roller, a fixed plate, and the like and further, it is also possible to use a heating section of non-contact heating system, such as an infrared heater.

The fixer fluid applying section 6 comprises a fixer fluid supplying section 36, the fixing roller 39, and a pressure roller 40. The fixer fluid supplying section 36 supplies the fixer fluid 9 to the surface of a fixing roller 39. The fixing roller 39 is capable of rotating in an arrow sign 54 direction by a driving section (not shown), for applying the fixer fluid 9 to at least an entire image forming region of a toner image carrying face of the recording medium 8. The pressure roller 40 pressure-contacts the fixing roller 39 and is capable of rotating in an arrow sign 55 direction so as to follow rotation of the fixing roller 39.

The fixer fluid supplying section 36 comprises a fixer fluid tank 48, a fixer fluid supplying roller 49, a regulating roller 51, a removing blade 53, a fixer fluid storing bath (not shown), and a supplying pipe (not shown). The fixer fluid tank 48 has an opening which faces the fixing roller 39, and stores the fixer fluid 9 therein. The fixer fluid supplying roller 49 pressure-contacts the fixing roller 39 by protruding outward from the opening of the fixer fluid tank 48. A part of the fixer fluid supplying roller 49 is dipped in the fixer fluid 9 stored in the fixer fluid tank 48. The fixer fluid supplying roller 49 is capable of rotating in an arrow sign 50 direction by a driving section (not shown). The regulating roller 51 pressure-contacts a surface of the fixer fluid supplying roller 49 and is capable of rotating in an arrow sign 52 direction by a driving section (not shown). The regulating roller 51 regulates the fixer fluid 9 to be attached to the surface of the fixer fluid supplying roller 49, to an appropriate amount. The removing blade 53 is a platy member provided so as to have one end thereof fixed to the fixer fluid tank 48 and the other end thereof pressure-contacted with a surface of the regulating roller 51. The removing blade 53 removes the fixer fluid 9 on the surface of the regulating roller 51. The fixer fluid storing bath 37 stores the fixer fluid 9. The supplying pipe supplies the fixer fluid 9 in the fixer fluid storing bath to the fixer fluid tank 48. Note that the fixer fluid supplying roller 49 and the regulating roller 51 are driven by a single gear row, and rotate at constant ratio of peripheral velocity.

According to a consuming state of the fixer fluid 9, the fixer fluid tank 48 is filled up with the fixer fluid 9 supplied from the fixer fluid storing bath via the supplying pipe so that liquid level of the fixer fluid 9 in the fixer fluid tank 48 is stable.

As the fixing supplying roller 49, a roller which is composed of a cored bar and an elastic layer formed on a surface of the cored bar, is used. For materials constituting the elastic layer in this case, it is preferable to use elastic materials such as silicone rubber, fluorocarbon rubber, or urethane rubber, which have high affinity with an after-described solvent component of the fixer fluid 9 and which are swelled on contacting the fixer fluid 9. Among these materials, the silicone rubber and the fluorocarbon rubber can be preferably used since the silicone rubber and the fluorocarbon rubber have smaller surface energy, and the toner is hardly attached thereto. A rotation direction of the fixer fluid supplying roller 49 at the pressure-contact portion with the fixing roller 39 is the same as that of the fixing roller 39. In addition, a peripheral velocity of the fixer fluid supplying roller 49 is set to be substantially the same as that of the fixing roller 39. In the example embodiment, a roller can be used as the fixer fluid supplying roller 49, which roller has an outer diameter of 20 mm and a silicone rubber layer on a surface thereof, having a thickness of 3 mm and hardness of 20 degrees (JIS-A) A press force of the fixer fluid supplying roller 49 against the fixing roller 39 is set to be at line pressure of 1 N/cm in the example embodiment.

The regulating roller 51 is composed of a metallic roller, for instance. In the example embodiment is used a roller formed of a stainless steel, having an outer diameter of 12 mm. Further, in the example embodiment, the regulating roller 51 rotates in such a direction that a surface thereof moves in a direction opposite to the moving direction of the surface of the fixer fluid supplying roller 49, that is to say, in the arrow sign 52 direction, at a pressure-contact portion with the fixer fluid supplying roller 49, at a peripheral velocity of which value is half of that of the fixer fluid supplying roller 49.

The removing blade 53 is composed of a platy member formed of metal, for instance. In the example embodiment is used a plate formed of stainless steel, having a thickness of 50 μm. The removing blade 53 has a tip pressure-contacted with the surface of the regulating roller 51 and thereby removes the fixer fluid 9 attached to the surface of the regulating roller 51.

By means of the fixer fluid supplying section 36, the fixer fluid supplying roller 49 firstly rotates in the fixer fluid 9 in the fixer fluid tank 48. By so doing, the fixer fluid 9 is attached to the surface of the fixer fluid supplying roller 49. This fixer fluid 9 is formed into a thin layer having a substantially even thickness by the regulating roller 51. In the example embodiment, a fixer fluid layer is formed on the surface of the fixer fluid supplying roller 49 at rate of approximately 16 g/m$^2$. This fixer fluid layer moves onto the fixing roller 39 at the pressure-contact portion between the fixer fluid supplying roller 49 and the fixing roller 39. At this time, an approximately half of the fixer fluid 9 on the fixer fluid supplying roller 49 moves to a surface of the fixing roller 39. Accordingly, the fixer fluid layer is formed on the fixing roller 39 at rate of 8 g/m$^2$ in the example embodiment. This fixer fluid layer carries the toner image and contacts the toner image carrying face of the recording medium 8 conveyed in the heated state so that the fixer fluid 9 is applied to at least a toner image forming region of the recording medium 8.

As the fixing roller 39, a roller-shaped member is used which is composed of a metallic cored bar 39*a*, an elastic layer 39*b*, and a surface layer 39*c*, the elastic layer 39*b* and the surface layer 39*c* being sequentially laminated on a surface of the metallic cored bar 39*a*. Heretofore known elastic materials can be used for the elastic layer 39*b*, however it is preferable to use rubbers such as EFDM rubber, butyl rubber, nitrile rubber, chloroprene rubber, and styrene butadiene rubber, which are not swelled by the fixer fluid 9 and well fitted to a roller shape By forming the elastic layer 39*b* of materials which are not swelled by the fixer fluid 9, it is possible to prevent the outer diameter of the fixing roller 39 and further, a conveying speed of the recording medium 8 from changing. Such a rubber can be used alone or in combination. The surface layer 39*c* is preferably formed of fluorine resin such as polytetrafluoroethylene (PTFE), tetrafluoroethylene-perfluoroalkyl vinyl ether copolymer (PFA), tetrafluoroethylene-hexafluoropropylene copolymer (FEF), tetrafluoroethylene-ethylene copolymer (ETFE), polyvinylidene fluoride (PVDF), and polychlorotrifluoroethylene (PCTFE). The fluorine resin can be used alone or in combination. Since such fluorine resin has high affinity with a solvent component of the fixer fluid 9 having after-described composition, the fixer fluid 9 can be retained on the surface of the fixing roller 39 as a thin layer Due to the foregoing, only a small amount of the fixer fluid 9 is necessary for applying the fixer fluid 9 in a large area on the surface of the fixing roller 39 and therefore, it is possible to reduce the consumption of the fixer fluid 9 and moreover, wash away the unfixed toner by excess fixer fluid 9 so that the image can be prevented from being deteriorated. As a result, it is possible to prevent, for a long period of time, offset phenomenon that the toner attached to the fixing roller 39 is attached to an image face, so that stable images of high quality can be obtained for a long period of time with a small amount of the fixer fluid 9. Among the above-mentioned fluorine resin, PTFE is preferable. Since PTFE has all fluorine atoms linked with bond chains of carbon atom, which constitutes a main chain, the toner hardly attaches to PTFE, and PTFE has high affinity with the so vent component of the fixer fluid 9. Accordingly PTFE, is the most effective for reducing the consumption of the fixer fluid 9 and preventing the toner from being attached to the fixing roller 39.

In the embodiment, a roller used as the fixing roller 39 has an outer diameter of 30 mm. The roller is constituted as follows. On the cored bar 39*a* are provided the elastic layer 39*b* having a thickness of 3 mm, which is formed of the EPDM rubber having a hardness of 20 degrees (JIS-A), and the surface layer 39*c* having a thickness of 80 μm, which is formed of PFA.

In the example embodiment is employed an applying section of contact system for applying the fixer fluid 9 while contacting the recording medium 8, in order to give the fixer fluid 9 to the recording medium 8. However, the applying section is not limited to the above-described section. There may be used an applying section of non-contact system such as an ultrasonic transducer, and a micro-nozzle array used for spraying minute droplets generated by gas flow and the like, and an inkjet head.

As in the case of the fixing roller 39, a roller-shaped member is used as the pressure roller 40, which member is composed of a cored bar, an elastic layer formed on a surface of the cored bar, and a surface layer formed on a surface of the elastic layer. In the example embodiment, a roller having an outer diameter of 30 mm is used. This roller is composed of the cored bar, the elastic layer having a thickness of 3 mm, which is formed of the EPDM rubber having a hardness of 50 degrees (JIS-A), and the surface layer having a thickness of 80 μm, which is formed of PFA. Further, in the example embodiment, the press force of the pressure roller 40 against the fixing roller 39 is a line pressure of 10 N/cm.

The fixer fluid 9 is a liquid which softens and/or swells the toner. To be specific, the fixer fluid 9 includes an organic compound having an action of softening and/or swelling the toner (hereinbelow referred to as "a toner fixing organic compound"), and a solvent component being capable of dissolving or dispersing the toner fixing organic compound. The toner fixing organic compound includes, for instance, alcohols such as methyl alcohol, ethyl alcohol, propyl alcohol, isopropyl alcohol, and butyl alcohol; ketones such as acetone, methyl ethyl ketone, methyl butyl ketone, methyl isobutyl ketone, and diethyl ketone; ethers such as methyl ethyl ether, diethyl ether, methyl butyl ether, methyl isobutyl ether, and dimethyl ether; and esters formed by carboxylic acids such as formic acid, acetic acid, propionic acid, and butyric acid, and alcohols such as methanol, ethanol, and propanol Among these components, the ethers and the esters are preferable, and the esters are particularly preferable. Among these ethers, diethyl ether is particularly preferable. Among these esters, ethyl acetate, methyl acetate, methyl formate, and ethyl formate are further preferable, and ethyl acetate is particularly preferable. The toner fixing organic compound can be used alone or in combination. The toner fixing organic compound has volatility in a room temperature and excellent action of softening and/or swelling toner binder resin such as polyester.

A content of the toner fixing organic compound in the fixer fluid 9 may be appropriately selected from a wide range without particular limitation, but preferably 1 to 50% by weight of the total fixer fluid 9. In this case, further preferable is 5 to 50% by weight of the total fixer fluid 9, and particularly preferable is 10 to 40% by weight of the total fixer fluid 9. When the content of the toner fixing organic compound is less than 1% by weight of the total fixer fluid 9, the action of softening and/or swelling the toner becomes insufficient, so that the fixing strength of the toner image to the recording medium 8 may be reduced. In addition, when the content of the toner fixing organic compound exceeds 50% by weight of the total fixer fluid 9, the content of the solvent component is relatively reduced, which causes reduced permeability of the fixer fluid 9 into the toner image, and softening and/or swelling of only the surface layer of the toner image, with the result that the fixing strength of the toner image to the recording medium 8 may be reduced.

The solvent component is not particularly limited as long as the solvent component is a liquid component which can dissolve or disperse the toner fixing organic compound. However, in view of the permeability into the toner image, hydrofluoroether is preferable. Since hydrofluoroether has small surface tension and viscosity, hydrofluoroether permeates well the contact faces, etc. among the toner particles and between the toner and recording medium 8. Accordingly, the toner fixing organic compound is conveyed, together with hydrofluoroether, to the contact faces, etc. among the toner particles and between the toner and recording medium 8 so that the toner can be instantly softened and/or swelled. Moreover, hydrofluoroether has small evaporation latent heat and therefore vaporizes for a short time even in a room temperature so that the recording medium 8 is dried out more rapidly.

Heretofore known hydrofluoroether can be used, such as methyl nonafluoro butyl ether, methyl nonafluoro isobutyl ether ($C_3F_9OCH_3$), ethyl nonafluoro butyl ether, ethyl nonafluoro isobutyl ether ($C_3F_9OC_2H_5$), 1,1,2,2-tetrafluoro ethyl, and 2,2,2-trifluoro ethyl ether ($CHF_2CF_2OCH_2CF_3$). Hydrofluoroether can be used alone or in combination.

A content of hydrofluoroether in the fixer fluid 9 may be appropriately selected from a wide range without particular limitation, but preferably 50 to 99% by weight of the total fixer fluid 9. In this case, further preferable is 50 to 95% by weight of the total fixer fluid 9, and particularly preferable is 60 to 90% by weight of the total fixer fluid 9. When the content of hydrofluoroether is less than 50% by weight of the total fixer fluid 9, the permeability of the fixer fluid 9 into the toner image is reduced, so that only the toner constituting the surface layer of the toner image is softened and/or swelled, with the result that the fixing strength of the toner image to the recording medium 8 may be reduced. On the other hand, when the content of hydrofluoroether exceeds 99% by weight, the content of the toner fixing organic compound is relatively reduced so that the toner has reduced softening/swelling action, with the result that the fixing strength of the toner image to the recording medium 8 may become insufficient.

To the fixer fluid 9 can be added a release agent, surfactants, and the like, other than the toner fixing organic compound and the solvent component.

The release agent has the following effects, for instance. Specifically, when the fixer fluid 9 is applied via the fixing roller 39 to the toner image on the recording medium 8, the toner constituting the toner image is softened and/or swelled. The softened and/or swelled toner image has viscosity, being in a semi-molten state until solidification on the recording medium 8. Accordingly, the offset phenomenon may be caused that the toner image on the recording medium 8 is attached to the fixing roller 39-side without being fixed to the recording medium. When the offset phenomenon is generated, it is not possible to avoid serious image deterioration. When the release agent is added to the fixer fluid 9, it is possible to reduce the viscosity of the toner image. In this case, even the toner image in the semi-molten state has a further reduced possibility of causing the offset phenomenon The release agent includes silicone oil, ester oil, liquid polyether, spindle oil, machine oil, and cylinder oil Among the oils, silicone oil is preferable since silicone oil has excellent heat resistance and chemical stability, a high releasing effect, and a high effect for suppressing the viscosity of the toner image The preferable silicone oil has a viscosity of 0.0001 to 0.0005 $m^2/s$ (100 to 500 cSt, and 25° C.). Silicone oil having a viscosity in such a range is available in the market, for instance, as silicone oil of KF 96 (trade name) manufactured by Shin-Etsu Chemical Co., Ltd. A content of the release agent in the fixer fluid 9 may be appropriately selected from a wide range without particular limitation, but preferably 5 to 20% by weight of the total fixer fluid 9 and further preferably 10 to 15% by weight of the total fixer fluid 9. By adding the release agent in this range, the offset phenomenon can be further restrained from occurring so that it is possible to obtain images of high quality. When the content of the release agent is less than 5% by weight, the effect due to addition of the release agent cannot be sufficiently obtained so that the offset phenomenon cannot be further reduced. On the other hand, when the content of the release agent exceeds 20% by weight, the toner constituting the toner image cannot be sufficiently softened and/or fused, and it may tend to take a longer time to dry out the fixer fluid 9.

The surfactant has an effect of enhancing wettability of the fixer fluid 9 to the toner, an effect of dispersing the toner fixing organic compound into the solvent component, and an effect of dispersing the release agent into the solvent in a case where the solvent component of the fixer fluid 9 is aqueous and the oil-based release agent is added. As the surfactants, heretofore known surfactants can be used. The heretofore known surfactants include anionic surfactants such as fatty acid derivative sulfuric ester salt and phosphoric ester; cationic surfactants such as quaternary ammonium salt and heterocyclic amine; zwitterionic surfactants such as amino acid ester and amino acid; nonionic surfactant; polyoxyalkylene alkyl ether; and polyoxyethylene alkyl amine.

By means of the fixing section 6, when the recording medium a carrying the unfixed toner image, the recording medium 8 being placed on the conveying belt 31, is conveyed in the heated state and passes through the fixing nip portion between the fixing roller 39 and the pressure roller 40, the fixer fluid 9 is applied to at least the toner image forming region of the toner image carrying face of the recording medium 8 from the fixer fluid supplying section 36 via the fixing roller 39 and then, the toner constituting the toner image is softened and/or swelled and the recording medium 8 is pressurized by the pressure roller 40. By so doing, the toner image is fixed on the recording medium 8 so that the image is formed. The recording medium 8 on which the image has been formed is discharged to a catch tray 41 provided outside the image forming apparatus 1 by discharge rollers 56*a* and 56*b*.

The recording medium supplying section 7 comprises a recording medium cassette 42, a pick up roller 43, and a pair of registration rollers 44*a* and 44*b*. The recording medium cassette 42 stores the recording medium 8. The pick up roller 43 feeds the recording medium 8 sheet by sheet to a conveying path P. The pair of registration rollers 44*a* and 44*b* feeds the recording medium 8 to the pressure-contact portion between the secondary transfer roller 30 and the support roller 26 in synchronization with conveyance of the toner image on the intermediate transfer belt 21 to the pressure-contact portion between the secondary transfer roller 30 and the support roller 26.

By means of the recording medium supplying section 7, the recording medium 8 stored in the recording medium cassette 42 Is fed sheet by sheet to the conveying path P by the pick up roller 43. The recording medium 8 is further fed to the pressure-contact portion between the secondary transfer roller 30 and the support roller 26 by the registration rollers 44*a* and 44*b*.

By means of the image forming apparatus 1, the multicolored toner image formed on the intermediate transfer belt 21 by the toner image forming section 2 is transferred to the recording medium 8 at the pressure-contact portion between the secondary transfer roller 30 and the support roller 26. The multicolored toner image on the recording medium 8 contacts the fixer fluid 9 on the fixing roller 39, and the fixer fluid 9 is thus applied from the fixing roller 39 to the multicolored toner image on the recording medium 8. By so doing, the multicolored toner image is fixed on the recording medium 8 so that the image is formed.

According to the example embodiment, the toner image is heated before the fixer fluid 9 is applied to the recording medium 8 carrying the toner image and therefore, the to-be-heated recording medium 8 has a smaller heat capacity since the recording medium 8 does not contain the fixer fluid 9. Consequently, it is possible to increase temperatures of the recording medium 8 and further toner image, with a small amount of heat. In addition, when the fixer fluid 9 is applied, the toner image and the recording medium 8 are in the heated state and therefore, the to-be-applied fixer fluid 9 swiftly spreads over the toner image and permeates the toner image. In this case, the softening and/or swelling of the toner instantly occur in a large area so that it is possible to prevent the applied fixer fluid 9 from causing flux, agglomeration, or the like of the unfixed toner. Furthermore, a liquid temperature of the fixer fluid 9 in contact with the toner image increases so as to achieve sufficient fixing strength for a short time. Moreover, after the softening and/or swelling of the toner, the remaining fixer fluid 9 vaporizes for a short time and therefore, the recording medium 8 is rapidly dried out. These advantages enhance throughput that indicates the number of outputted sheets per hour by the image forming apparatus 1.

Figure 5:
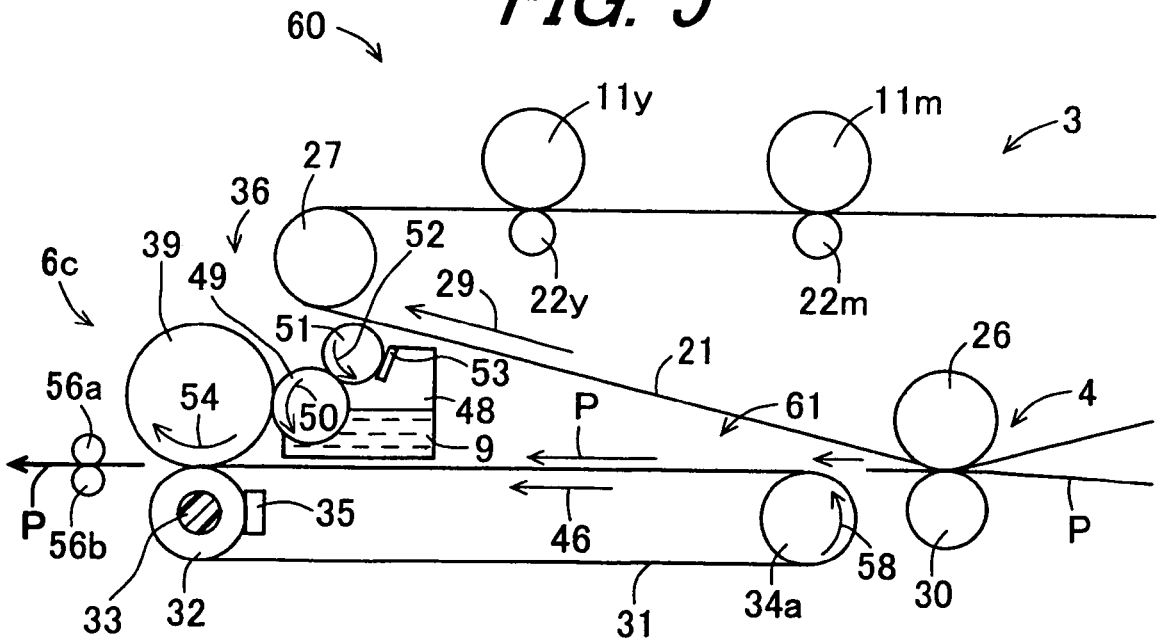
FIG. 5 is a side view schematically showing a configuration of a substantial part of an image forming apparatus according to a second example embodiment of the presently disclosed technology.

FIG. 5 is a side view schematically showing a configuration of a substantial part of an image forming apparatus 60 according to a second example embodiment of the presently disclosed technology. The image forming apparatus 60 is similar to the image forming apparatus 1, so that illustration and description of parts of the image forming apparatus 60, which parts have the same configuration as those of the image forming apparatus 1, will be omitted. Further, corresponding parts among the parts shown in FIG. 5 will be denoted by the same reference numerals, and description thereof will be omitted.

The image forming apparatus 60 has no pressure roller 40 which is included in the image forming apparatus 1. In a heating section 61 of the image forming apparatus 60, the heating roller 32 is used as one of the two rollers for stretching the conveying belt 31 and further, the heating roller 32 and the fixing roller 39 come into pressure-contact with each other via the conveying belt 31 so that the heating roller 32 functions as a pressure roller. The other configurations are the sane as those of the image forming apparatus 1.

That is to say, the image forming apparatus 60 comprises a toner forming section 2 (only photoreceptor drums 11*y* and 11*m* are shown), an intermediate transfer section 3 (only the intermediate transfer rollers 22*y* and 22*m*, the intermediate transfer belt 21, and the support rollers 26 and 27 are shown), a secondary transfer section 4, a heating section 61, a fixer fluid applying section 6, and a recording medium supplying section 7 (not shown).

The heating section 61 comprises a conveying belt 31, a driving roller 34*a*, a heating roller 32, and a temperature sensor 35. The conveying belt 31 is stretched between the heating roller 32 and a driving roller 34*a* and circulated in the arrow sign 46 direction. The driving roller 34*a* drives the conveying belt 31 The heating roller 32 heats the conveying belt 31 and the recording medium 8 placed on the conveying belt 31, The temperature sensor 35 is provided on the surface of the heating roller 32, for detecting a surface temperature of the heating roller 32. Since the conveying belt 31 is in the heated state by the heating roller 32, the recording medium 8 carrying the unfixed toner image, which recording medium 8 is placed on the conveying belt 31 and conveyed, is heated The driving roller 34*a* is supported by a driving section (not shown) so as to be capable of rotating. This driving force in an arrow sign 58 direction drives the conveying belt 31 to rotate in the arrow sign 46 direction The heating roller 32 pressure-contacts the fixing roller 39 via the conveying belt 31, and heats the recording medium 8, which is conveyed to the pressure-contact portion between the heating roller 32 and the fixing roller 39, from a back side of an unfixed toner carrying face thereof, Moreover, the heating roller 32 promotes the fixing of the toner image onto the recording medium 8 by reciprocal operation thereof with the fixing roller 39. The surface temperature (heating temperature) of the heating roller 32 is not particularly limited. The temperature may be appropriately set in view of the temperatures of glass transition point and softening point, and the like of the to-be-used toner. In the example embodiment, the toner having a glass transition point 60° C. is used. Accordingly, the surface temperature of the heating roller 32 is set to 70° C. so that a temperature of a pressure-contact starting point at the pressure-contact portion between the heating roller 32 and the fixing roller 39 is slightly lower than 60° C. (the glass transition point of the toner). Note that in the example embodiment, the heating roller 32 has a function also as a tension roller for giving a predetermined tension to the conveying belt 31.

The temperature sensor 35 is provided at a position in contact with or close to the heating roller 32, in order to have a constant surface temperature of the heating roller 32.

In the example embodiment, the surface temperature of the heating roller 32 is set to 70° C., but not limited to this value. For instance, the surface temperature of the heating roller 32 may be set to 80° C. so that the temperature at the contact starting point at the pressure-contact portion between the heating roller 32 and the fixing roller 39 is higher than the temperature of the glass transition point (60° C.) of the toner. This makes it possible to soften the toner before the fixer fluid 9 is applied, and increase the adherence among the toners, and adherence between toner and the recording medium 8, so as to prevent the toner from moving, being agglomerated, and the like by the fixer fluid 9 when the fixer fluid 9 is applied.

In the example embodiment, the surface temperature of the heating roller 32 may be set to 140° C. so that the temperature at the contact starting point at the pressure-contact portion between the heating roller 32 and the fixing roller 39 is higher than the temperature of the glass transition point (120° C.) of the toner. This makes it possible to sufficiently soften the toner before the fixer fluid 9 is applied, and further increase the adherence among the toners, and adherence between the toner and the recording medium 8, so as to further prevent the toner from moving, being agglomerated, and the like by the fixer fluid 9 when the fixer fluid 9 is applied.

Further, in the example embodiment, fluorine resin is used for the surface layer 39*c* of the fixing roller 39 while hydrofluoroether is used as the solvent component of the fixer fluid 9, but the materials are not limited to this combination. The surface layer 39*c* of the fixing roller 39 and the solvent component of the fixer fluid 9 may be formed of materials in any combination which can apply a thin layer of the fixer fluid 9 uniformly to the toner image.

By means of the heating section 61, the recording medium 8 carrying the toner image is placed on the conveying belt 31 and conveyed under heating to the pressure-contact portion between the heating roller 32 and the fixing roller 39 At the pressure-contact portion, the fixer fluid 9 is applied to the toner image forming region of the recording medium 8. At the same time, the recording medium 8 is heated by the heating roller 32. This makes it possible to fix the toner image to the recording medium 8 so that the image is formed. The recording medium 8 on which the image has been formed is discharged to outside of the image forming apparatus 60 by the discharge rollers 56*a* and 56*b*.

A fixing solution applying section 6*c* has the same configuration as that of the fixer fluid applying section 6 included in the image forming apparatus 1, except that the pressure roller 40 included in the image forming apparatus 1 is replaced by the heating roller 32 in the image forming apparatus 60. Actions obtained by the replacement by the heating roller 32 are mentioned above. With this configuration, a heat quantity for compensating temperature decrease of the toner and recording medium 8 due to the application of the fixer fluid 9 is supplied during the application of the fixer fluid 9. As a result, the temperatures of the toner, recording medium 8, and fixer fluid 9 shortly after the application of the fixer fluid 9 become high so that the fixer fluid 9 spreads and permeates more rapidly. This leads the instant softening and/or swelling of the toner in a large area so that the sufficient fixing strength can be obtained for a short time. Furthermore, the temperature of the fixer fluid 9 increases and therefore, it is possible to dry cut the fixer fluid 9 for a short time. These advantages further enhance throughput that indicates the number of outputted sheets per hour by the image forming apparatus.

Figure 6:
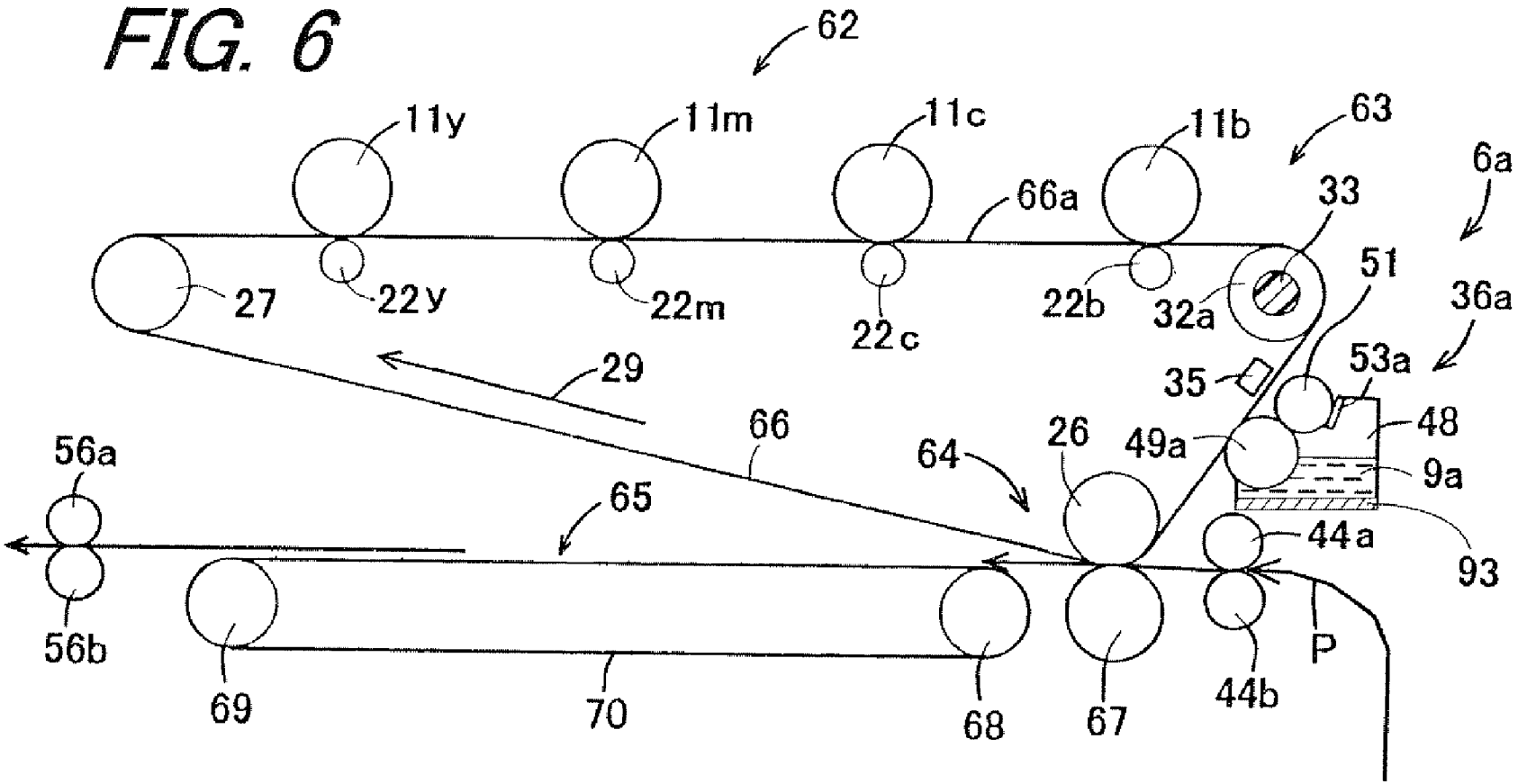
FIG. 6 is a side view schematically showing a configuration of a substantial part of an image forming apparatus according to a third example embodiment of the presently disclosed technology.
Figure 7:
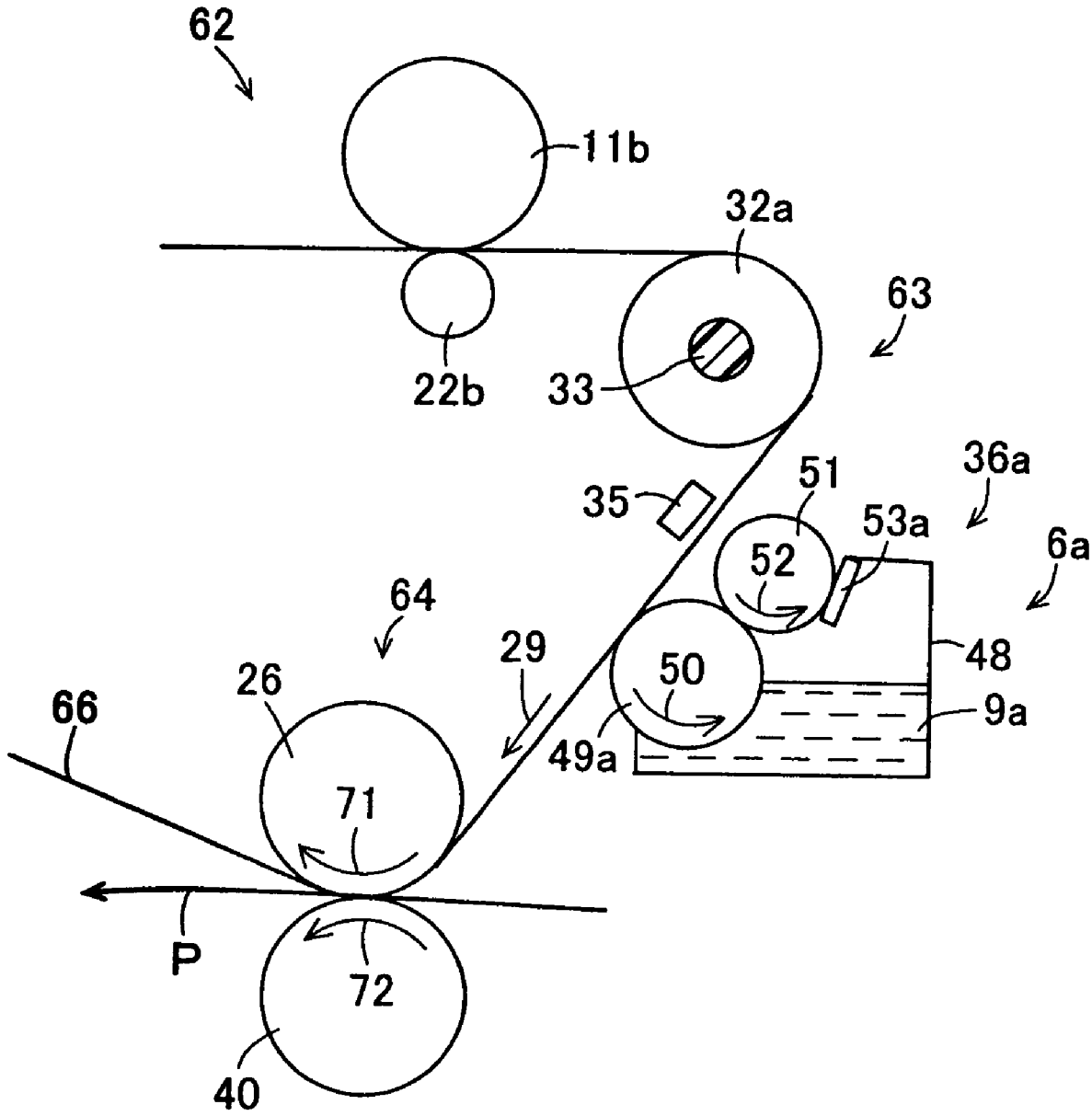
FIG. 7 is an enlarged side view showing the substantial part of the image forming apparatus shown in FIG. 6.

FIG. 6 is a side view schematically showing a configuration of a substantial part of an image forming apparatus 62 according to a third example embodiment of the presently disclosed technology. FIG. 7 is an enlarged side view showing the substantial part of the image forming apparatus shown 62 in FIG. 6.

The image forming apparatus 62 is similar to the image forming apparatus 1, so that corresponding parts will be denoted by the same reference numerals, and description thereof will be omitted. Further, illustration and description of the same parts will be omitted.

In the image forming apparatus 62, a heating roller 32*a* serving as a hating section, and a fixer fluid supplying section 6*a* contact an intermediate transfer belt 66 between a downstream side in a rotation direction (an arrow sign 29 direction) of the intermediate transfer belt 66 to the intermediate transfer position of the toner image from the photoreceptor drums 11*y*, 11*m*, 11*c* and 11*b* onto the intermediate transfer belt 66, and an upstream side in the rotation direction (the arrow sign 29 direction) of the intermediate transfer belt 66 to the transfuse position of the toner image onto the recording medium 8 due to a transfuse section 64. The heating roller 32*a* is used instead of the support roller 25 included in the image forming apparatus 1.

Moreover, in the image forming apparatus 62, the toner image which is heated on the intermediate transfer belt and the fixer fluid 9 is applied to, is fixed by the transfuse section 64 during the transfer to the recording medium 8.

That is to say, the image forming apparatus 62 comprises the toner image forming section 2 (only the photoreceptor drums 11*y*, 11*m*, 11*c* and 11*b* are shown), an intermediate transfer section 63, a fixer fluid applying section 6*a*, a transfuse section 64, a conveying section 65, and a recording medium supplying section 7 (only the registration rollers 44*a* and 44*b* are shown)

The intermediate transfer section 63 comprises an intermediate transfer belt 66, intermediate transfer rollers 22*y*, 22*m*, 22*c* and 22*b*, a heating roller 32*a*, support rollers 26 and 27, a temperature sensor 35, and a belt cleaner (not shown). Compared to the intermediate transfer section 3 in the image forming apparatus 1, it is mainly different in that the support roller 25 in the intermediate transfer section 3 is replaced by the heating roller 32*a* and that the intermediate transfer belt 66 and the toner image carried on the intermediate transfer belt 66 are heated.

As the intermediate transfer belt 66, a belt having no end is used The belt is composed of the sequentially laminated polyimide film having a thickness of 100 μm, silicone rubber layer having a thickness of 500 μm, and coating layer formed of fluorine resin composition containing PTFE and PFA at proportion of 8 to 2 (weight ratio). In the materials constituting the intermediate transfer belt 66, the conductive agents such as carbon are mixed in order to adjust a value of electric resistance The heating roller 32*a* can rotate about a shaft line thereof while the intermediate transfer belt 66 is stretched by the heating roller 32*a* together with the support rollers 26 and 27. The heating roller 32*a* has a function of heating the intermediate transfer belt 66 The heating roller 32*a* is composed of a metallic cylinder and the heater 33 provided in the cylinder. In the example embodiment is used a roller composed of a pipe formed of stainless steel, having a thickness of 1 mm, and a halogen lamp disposed inside the pipe.

In order to detect a temperature of the intermediate transfer belt 66, the temperature sensor 35 is provided at a downstream side to the contact region of the heating roller 32*a* and the intermediate transfer belt 66 in a direction that the intermediate transfer belt 66 is circulated, that is to say, in the arrow sign 29 direction, so as to contact or come close to the intermediate transfer belt 66. A detected result due to the temperature sensor 35 is stored in CPU (not shown) for controlling entire operation of the image forming apparatus 62. On the basis of the detected result stored in the CPU, the CPU sends a signal to a power source (not shown) for applying voltage to the heating roller 33 so that heat generation due to the heating roller 33 is adjusted. The intermediate transfer belt 66 is thus controlled to have a constant temperature. In the example embodiment, the temperature of the intermediate transfer belt 66 is set to be slightly lower than the temperature of the glass transition point (60° C.) of the toner used in this case.

By means of the intermediate transfer section 63, the toner image, which are transferred to a toner carrying face 66*a* of the intermediate transfer belt 66 by combining the toners from the photoreceptor drums 11*y*, 11*m*, 11*c* and 11*b*, is fed to the transfuse section 64 after the toner image is heated by the heating roller 32*a* and the fixer fluid 9*a* is applied to the toner image by the fixer fluid applying section 6*a*, in accordance with circulation of the intermediate transfer belt 66.

The fixer fluid applying section 6*a* comprises the fixer fluid supplying section 36*a* for applying the fixer fluid 9*a* to the Goner carrying face 66*a* of the intermediate transfer belt 66, a fixer fluid storing bath (not shown), and a fixer fluid supplying pipe (not shown).

The fixer fluid supplying section 36*a* comprises a fixer fluid tank 48, a fixer fluid supplying roller 49*a*, a regulating roller 51, and a removing blade 53*a*. The fixer fluid tank 48 stores the fixer fluid 9*a*. The fixer fluid supplying roller 49*a* pressure-contacts the intermediate transfer belt 66 and has a part thereof dipped in the fixer fluid 9*a* stored in the fixer fluid tank 48. The fixer fluid supplying roller 49*a* is provided at an opening of the fixer fluid tank 48*a* so as to be capable of rotating in the arrow sign 50 direction by a driving section (not shown). The regulating roller 51 pressure-contacts a surface of the fixer fluid supplying roller 49*a* and is capable of rotating in the arrow sign 52 direction by a driving section (not shown). The regulating roller 51 regulates the fixer fluid 9*a* to be attached to the surface of the fixer fluid supplying roller 49*a*, to an appropriate amount. The removing blade 53*a* has one end thereof fixed to the fixer fluid tank 48 and the other end thereof pressure-contacted with the surface of the regulating roller 51 The removing blade 53*a* removes the fixer fluid 9*a* on the surface of the regulating roller 51. Note that the fixer fluid supplying roller 49*a* and the regulating roller 51 are driven by a single gear row, and rotate at constant ratio of peripheral velocity.

The fixer fluid tank 48 has the same configuration as that of the fixer fluid tank 48 included in the fixer fluid supplying section 36 of the image forming apparatus 1.

As the fixing supplying roller 49*a*, a roller is used which is composed of a cored bar, an elastic layer formed on a surface of the cored bar, and a hydrophilic layer formed on a surface of the elastic layer. For the elastic layer, silicone rubber, fluorocarbon rubber, and urethane rubber are used, for instance. For the hydrophilic layer, PTFE to which hydrophilic treatment has been applied is used, for instance. Furthermore, at least a surface layer of the fixer fluid supplying roller 49*a* may comprise materials which have favorable wettability with the after-described fixer fluid 9*a*. The materials include, for instance, metals such as aluminum, hydrophilic resin, and hydrophilic rubber materials without particular limitation. By providing such a hydrophilic surface layer, the fixer fluid 9*a* can be retained as a thin layer. In addition, since only a small amount of the fixer fluid 9*a* is necessary for applying the fixer fluid 9*a* in a large area, it is possible to reduce the consumption of the fixer fluid 9*a* and moreover, excess fixer fluid 9*a* can wash away unfixed toner so that the image can be prevented from being deteriorated.

In the example embodiment, a roller is used as the fixer fluid supplying roller 49, which roller is composed of the cored bar having a diameter of 12 mm, the elastic layer formed of elastic silicone rubber provided on the cored bar, and the hydrophilic layer formed of PTFE to which hydrophilic treatment has been applied, the hydrophilic layer having a thickness of 10 μm and being provided on a surface of the elastic layer. Moreover, in the example embodiment, the fixer fluid supplying roller 49*a* pressure-contacts the intermediate transfer belt 66 at line pressure of 0.5 N/cm. Further, the fixer fluid supplying roller 49 rotates at a velocity which is 2% slower than rotation velocity of the intermediate transfer belt 66.

The regulating roller 51 has the same configuration of the regulating roller 51 included in the fixer fluid supplying section 36 of the image forming apparatus As the removing blade 53*a*, a plate formed of stainless steel, which has a thickness of 40 μm is used.

As the fixer fluid 9*a*, a composition containing water and the toner fixing organic compound is used while the water is used as the solvent component. In this case, the toner fixing organic compound may be selected from the above-exemplified components which can be dissolved or dispersed in water. A content of water in the fixer fluid 9*a* is not particularly limited, but preferably more than 20% by weight of the total fixer fluid 9*a*. In this case, further preferable is 20 to 95% by weight, and particularly preferable is 30 to 90% by weight of the total fixer fluid 9*a*. And the rest of the total fixer fluid 9*a* is the toner fixing organic compound. In order to enhance dispersibility of the toner fixing organic compound in water, an appropriate amount of surfactants can be added to the fixer fluid 9*a*. The surfactants include, for instance, fatty alcohol sulfate such as lauryl sulfate ester sodium salt; higher fatty acid metal salt such as sodium oleate; anionic surfactants such fatty acid derivative sulfuric ester salt and phosphoric ester; cationic surfactants such as quaternary ammonium salt and heterocyclic amine; zwitterionic surfactants such as amino acid ester and amino acid; nonionic surfactant; polyoxyalkylene alkyl ether; and polyoxyethylene alkyl amine. Furthermore, it is possible to add an appropriate amount of dispersing auxiliaries to the fixer fluid 9*a*. The dispersing auxiliaries include, for instance, diethylene glycol, triethylene glycol, polyethylene glycol, monobutyl ether, and diethylene glycol mononethyl ether. Such a fixer fluid 9*a* does not permeate the intermediate transfer belt 66.

By means of the fixer fluid supplying section 36*a*, the fixer fluid supplying roller 49*a* firstly rotates in the fixer fluid 9*a* in the fixer fluid tank 49. By so doing, the fixer fluid 9*a* is attached to the surface of the fixer fluid supplying roller 49*a* so that a layer of the fixer fluid 9*a* is formed. This layer is formed into a thin layer having a substantially even thickness by the regulating roller 51. This fixer fluid layer moves onto the toner carrying face 66*a* of the intermediate transfer belt 66 at the pressure-contact portion between the fixer fluid supplying roller 49*a* and the intermediate transfer belt 66. At this time, an approximately half of the fixer fluid 9*a* on the fixer fluid supplying roller 49*a* moves to a surface of the toner carrying face 66*a*.

By means of the fixer fluid applying section 6*a*, the fixer fluid 9*a* s applied by the intermediate transfer section 63 to the toner image in a heated state on the intermediate transfer belt 66. The toner image on the intermediate transfer belt 66 is softened and/or swelled when the toner image is heated and the fixer fluid 9*a* is applied to the toner image.

The transfuse section 64 comprises a support roller 26 being capable of rotating in an arrow sign 71 direction; and a pressure roller 40 being capable of rotating in an arrow sign 72 direction, which support roller 26 and pressure roller 40 face each other via the intermediate transfer roller 66.

The pressure roller 40 has the same configuration as that of the pressure roller 40 included in the fixer fluid applying section 6 of the image forming apparatus 1. The pressure roller 40 pressure-contacts the intermediate transfer belt 66 at line pressure of 5 N/cm. Further, no voltage is applied to the pressure roller 40.

By means of the transfuse section 64, the intermediate transfer belt 66 carrying the toner image in the softened and/or swelled state moves to the pressure-contact portion between the support roller 26 and the pressure roller 40. In synchronization with this movement, the recording medium 3 is conveyed by a recording medium supplying section (not shown) to the pressure-contact portion between the support roller 26 and the pressure roller 40, where a toner image carrying portion of the intermediate transfer belt 66 and the recording medium 8 are overlapped and pressed on each other. Since this toner image as in the softened and/or swelled state, this toner image is attached to the recording medium 8 by pressure. At this time, in a case where the recording medium 8 is a paper or the like, the toner image deeply enters into paper fabric, and the toner particles are simultaneously fused with each other so that a surface of the toner image become flat and smooth. As a result, it is possible to obtain a color image of high quality, having excellent coloration due to the subtractive color mixture, and surface sheen. In the example embodiment, since a fluorine resin layer having a small adherence to the toner is provided on the surface of the intermediate transfer belt 66, the substantially total amount of the toner image is transferred to the recording medium 8. In addition, since the intermediate transfer belt 66 has an elastic layer under the fluorine resin layer therein, the intermediate transfer belt 66 is deformed according to irregularity on the surface of the recording medium 8. Accordingly, the toner image can be made to contact even a concave portion of the recording medium 8 so that it is possible to obtain an evenly transferred and fixed image.

The conveying section 65 comprises a driving roller 68 being capable of rotating about a shaft line thereof by a driving section (not shown); a tension roller 69; and a conveying belt 70 having no end thereof, stretched by the driving roller 68 and the tension roller 69, the conveying belt 70 being circulated. By means of the conveying section 65, the recording medium 8 which the toner image has been transferred and fixed to by the transfuse section 64 and thus the image has been formed on, is conveyed so as to be discharged to outside of the image forming apparatus 62. The recording medium 8 conveyed by the conveying section 65 is discharged through the discharge rollers 56*a* and 56*b* to a catch tray (not shown) provided outside the image forming apparatus 62.

By means of the image forming apparatus 62, the toner image transferred on the intermediate transfer belt 66 is made to be in the softened and/or swelled state when the toner image is heated and the fixer fluid 9*a* is applied so that the toner image is transferred and fixed to the recording medium 8.

In the example embodiment, since the fixer fluid 9*a* is applied to the intermediate transfer belt 66 which the fixer fluid 9*a* does not permeate, most of the applied fixer fluid 9*a* can be attached to only the toner image. This makes it possible to reduce usage of the fixer fluid 9*a*.

Further, in the example embodiment, since the fixer fluid 9*a* is applied to the toner image on the intermediate transfer belt 66, paper dust such as fabric constituting paper is not attached to the surface of the fixer fluid supplying roller 49*a*, so that the paper dust will not be mixed in the fixer fluid 9*a* in the fixer fluid tank 48. As a result, the fixer fluid layer is not made to be uneven on the fixer fluid supplying roller 49*a* due to attachment of the paper dust onto the removing blade 53*a*, so that it is possible to stably obtain images of high quality for a long period of time.

Further, in the example embodiment, since a solution or water dispersion having a small viscosity is used as the fixer fluid 9*a*, the fixer fluid 9*a* swiftly permeates interfaces among the toner particles, and an interface between the toner particles and the intermediate transfer belt 66 so that the toner can be instantly softened and/or swelled. Furthermore, by employing a constitution (e.g., heater 93) to heat the fixer fluid 9*a* in the fixer fluid tank 48, after the toner image has been transferred and fixed to the recording medium 8, the fixer fluid 9*a* remaining on the recording medium 8 can be dried out for a short time even in a room temperature.

Figure 8:
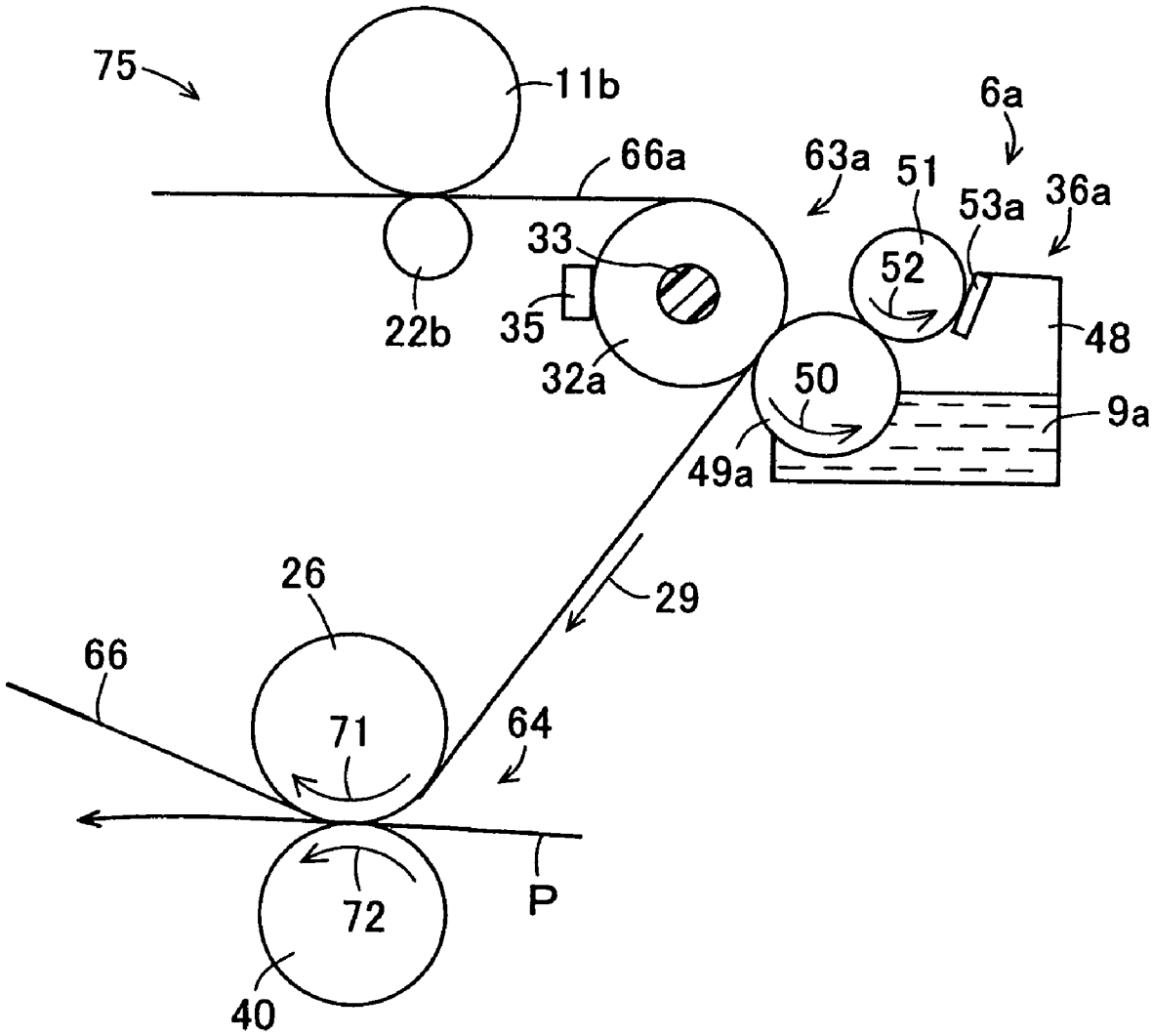
FIG. 8 is a side view schematically showing a configuration of a substantial part of an image forming apparatus according to a fourth example embodiment of the presently disclosed technology.

FIG. 8 is a side view schematically showing a configuration of a substantial part of an image forming apparatus 75 according to a fourth embodiment of the presently disclosed invention.

The image forming apparatus 75 is similar to the image forming apparatus 62, so that corresponding parts will be denoted by the same reference numerals, and description thereof will be omitted. Further, illustration and description of the same parts will be omitted.

The image forming apparatus 75 has the same configuration except that the temperature sensor 35 is disposed so as to contact or come close to the heating roller 32*a*, that the fixer fluid supplying roller 49*a* of the fixer fluid supplying section 36*a* faces the heating roller 32*a* via the intermediate transfer belt 66, and that the fixer fluid supplying section 36*a* is disposed so that the fixer fluid supplying roller 49*a* pressure-contacts the intermediate transfer belt 66.

That is to say, in the image forming apparatus 75, intermediate transfer section 63*a* comprises support rollers 26 and 27, a heating roller 32*a*, an intermediate transfer belt 66, intermediate transfer rollers 22*y*, 22*m*, 22*c* and 22*b*, and a temperature sensor 35. The intermediate transfer belt 66 is stretched over the support rollers 26 and 27 and the heating roller 32*a*, and circulated. The intermediate transfer rollers 22*y*, 22*m*, 22*c* and 22*b* transfer the toner images on photoreceptors drums 11*y*, 11*m*, 11*c* and 11*b* to the intermediate transfer belt 66. The temperature sensor 35 is disposed so as to contact or come close to the surface of the heating roller 32*a*, and detects a surface temperature of the heating roller 32*a*.

Further, in the fixer fluid supplying section 36*a* of the fixer fluid applying section 6*a*, the fixer fluid supplying roller 49*a* pressure-contacts the intermediate transfer belt 65 at a position where the fixer fluid supplying roller 49*a* faces the heating roller 32*a* via the intermediate transfer belt 66.

By means of the intermediate transfer section 63*a* and the fixer fluid applying section *a*, the toner image carried by the toner carrying face 66*a* of the intermediate transfer belt 66 is conveyed to the pressure-contact portion between the intermediate transfer belt 66 and the fixer fluid supplying roller 49*a* while heated by the heating roller 32*a*. In the example embodiment, the surface temperature of the heating roller 32*a* is set to 70° C. so that the temperatures of the intermediate transfer belt 66 and toner image at the contact starting point between the intermediate transfer belt 66 and the fixer fluid supplying roller 49*a* are slightly lower than the temperature of the glass transition point (60° C. in this case) of the toner constituting the toner image. At this pressure-contact portion, the fixer fluid 9*a* is applied to the toner image while heated so that the toner is softened and/or swelled.

By means of the image forming apparatus 75, the toner image on the intermediate transfer belt 66, which toner image has been softened and/or swelled by applying the fixer fluid 9*a* thereto while heated, is directly conveyed to the transfuse section 64 and transferred and fixed onto the recording medium 8 so that the image is formed on the recording medium 8. This recording medium 8 is discharged to outside of the image forming apparatus 75 by the conveying section 65.

With this configuration, it is possible to supply a heat quantity for compensating temperature decrease to the intermediate transfer belt 66 and the toner image at the same time when the intermediate transfer belt 66, the toner image and fixer fluid 9*a* carried on the intermediate transfer belt 66 have decreased temperatures at the time of application of the fixer fluid 9*a*. It is thus possible to prevent the temperature decrease of the intermediate transfer belt 66, the toner image and fixer fluid 3*a* on the intermediate transfer belt 66 shortly after the application of the fixer fluid 9*a*, and therefore the just-applied fixer fluid 9*a* swiftly spreads over the toner image and permeates the toner image so that the toner is instantly softened and/or swelled in a large area. Consequently, when the toner image is pressed to the recording medium 8 by the transfuse section 64, the toner image is solidly attached to the recording medium 6 so that high fixing strength is achieved. Further, the temperature of the applied fixer fluid 9*a* itself increases by heating due to the heating roller 32*a* and therefore, the fixer fluid 9*a* can be dried out for a short time after the fixer fluid 9*a* has been applied or transferred and fixed. These effects further enhance throughput that indicates the number of outputted sheets per hour by the image forming apparatus 75.

In the embodiment, the surface temperature of the heating roller 32*a* is set to 70° C., and the temperature of the toner image just before the fixer fluid 9*a* is applied is set to be slightly lower than the temperature of the glass transition point (60° C.) of the toner. However, the temperatures of the heating roller 32*a* and toner image are not limited to the above values. For instance, the surface temperature of the heating roller 32*a* may be set to 80° C., and the temperature of the toner image just before the fixer fluid 9*a* is applied may be set to be higher than the temperature of the glass transition point (60° C.) of the toner and lower than the temperature of the softening point (120° C. in this case) of the toner. In this case, the toner constituting the toner image is softened before the application of the fixer fluid 9*a* so that the adherence among the toners, and the adherence between the toner and the intermediate transfer belt 66 become higher. This makes it possible to prevent the toner from moving, being agglomerated, and the like due to liquid current of the fixer fluid 9*a* when the fixer fluid 9*a* is applied. Moreover, for instance, the surface temperature of the heating roller 32 may be set to 150° C., and the temperature of the toner image just before the fixer fluid 9*a* is applied is set to be higher than the temperature of the softening point (120° C.) of the toner. In this case, the toner image is further softened before the fixer fluid 9*a* is applied so that the adherence among the toners, and the adherence between the toner and the intermediate transfer belt 66 become further higher. This makes it possible to prevent the toner from moving, being agglomerated, and the like when the fixer fluid 9*a* is applied.

Figure 9:
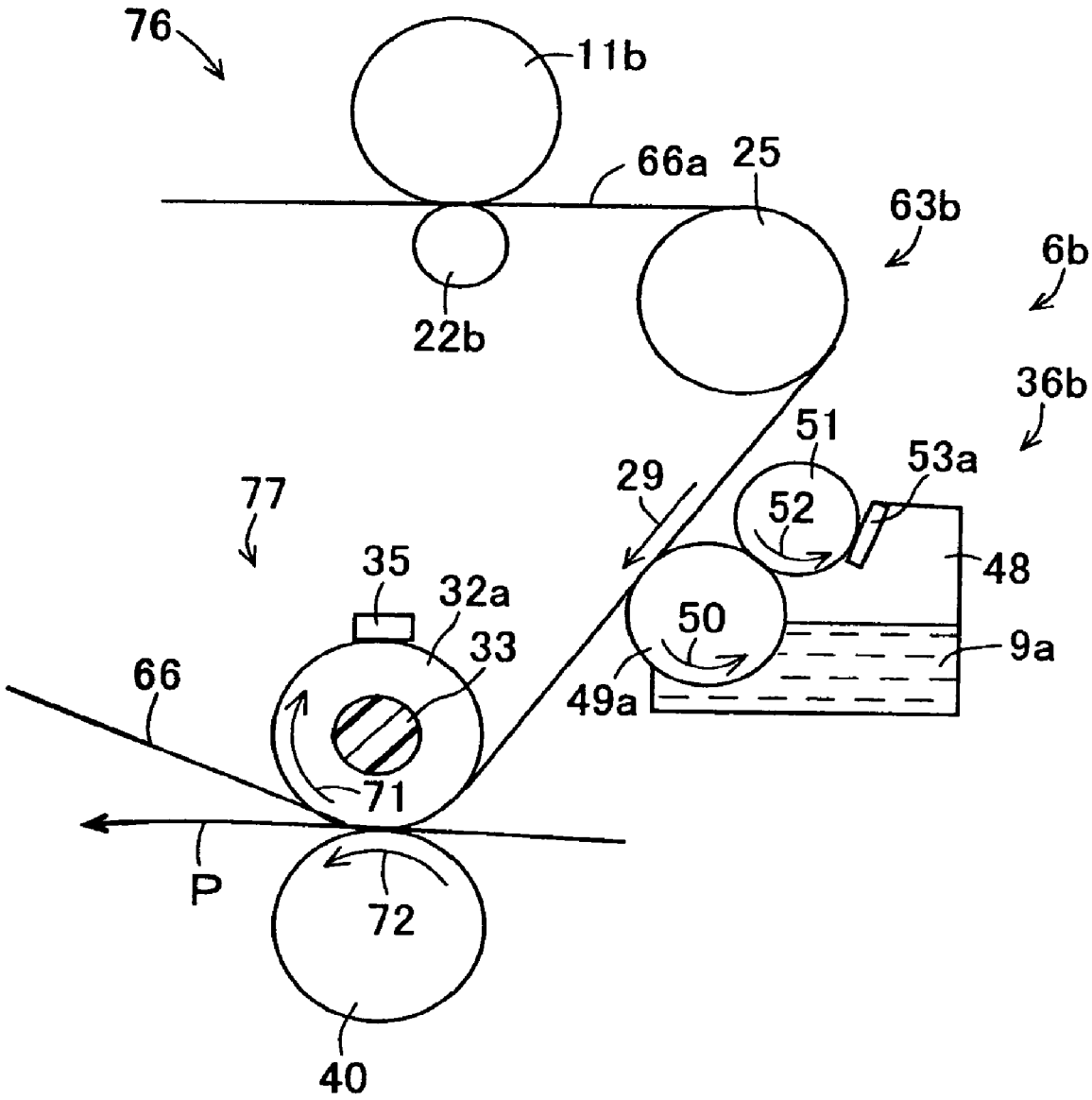
FIG. 9 is a side view schematically showing a configuration of a substantial part of an image forming apparatus according to a fifth example embodiment of the presently disclosed technology.

FIG. 9 is a side view schematically showing a configuration of a substantial part of an image forming apparatus 76 according to a fifth example embodiment of the presently disclosed technology.

The image forming apparatus 76 is similar to the image forming apparatus 62, so that corresponding parts will be denoted by the same reference numerals, and description thereof will be omitted. Further, illustration and description of the same parts will be omitted.

In the image forming apparatus 76, at a position of the support roller 26 included in the image forming apparatus 62, a heating roller 32*a* faces a pressure roller 40 via an intermediate transfer belt 66 and pressure-contacts the intermediate transfer belt 66 as the support roller 26 does. A temperature sensor 35 is provided so as to contact or come close to the surface of the heating roller 32*a*. A support roller 25 is provided at a position where the heating roller 32*a* is provided in the image forming apparatus 62.

Further, in a fixer fluid supplying section 36*b* of the image forming apparatus 76, in order to maintain the constant temperature of the fixer fluid 9*a*, a temperature control section (not shown) is provided in a fixer fluid tank 48.

That is to say, the image forming apparatus 76 comprises a toner image forming section 2 (only a photoreceptor drum 11*b* is shown), an intermediate transfer section 63*b* (only intermediate transfer roller 22*b*, intermediate transfer belt 66, support roller 25 and heating roller 32*a* are shown), a fixer fluid applying section 6*a*, a transfuse section 77, a conveying section 65 (not shown), and a recording medium supplying section 7 (not shown).

The intermediate transfer section 63*b* comprises a heating roller 32*a*, a support roller 27 (not shown), an intermediate transfer belt 66, intermediate transfer rollers 22*y*, 22*m*, 22*c* and 22*d* (partially not shown), and a temperature sensor 35. The heating roller 32*a* is capable of rotating in an arrow sign 71 direction. The intermediate transfer belt 66 is stretched over the support rollers 25 and 27 and the heating roller 32*a*, and circulated. The intermediate transfer rollers 22*y*, 22*m*, 22*c* and 22*b* transfer the toner images on the photoreceptor drums 11*y*, 11*m*, 11*c* and 1l*b* (partially not shown) to the intermediate transfer belt 66. The temperature sensor 35 is disposed so as to contact or come close to the surface of the heating roller 32*a*, and detects the surface temperature of the heating roller 32*a*. By means of the intermediate transfer section 63*b*, the toner images of the respective colors on the photoreceptor drums 1l*y*, 11*m*, 11*c* and 1l*b* are combined and transferred on the toner carrying face 66*a* of the intermediate transfer belt 66 so that one toner image is formed. This toner image is conveyed according to the circulation of the intermediate transfer belt 66.

The heating roller 32*a* is very easily provided with the temperature sensor 35 for detecting the surface temperature of the heating roller 32*a*. Due to the temperature sensor 35, the intermediate transfer belt 66 and the toner image can be heated to a constant temperature and moreover, under a constant condition, the fixer fluid 9*a* can be applied and the toner image can be transferred and fixed to the recording medium 8. Accordingly, it is possible to obtain the image of high quality at any time. In contrast, in a case where the fixer fluid 9*a* is applied to a recording paper of the recording medium 8, it is necessary to change applying conditions (such as application amount, liquid temperature at the time of application, and applying velocity), depending on types of recording papers (such as thickness and liquid permeability). Furthermore, it is not easy to provide the temperature sensor or the like.

The fixer fluid applying section 6*b* comprises a fixer fluid supplying section 36*b*, fixer fluid storing tank (not shown) for storing the fixer fluid 9*a*, and fixer fluid supplying pipe (not shown) for supplying the fixer fluid 9*a* in the fixer fluid storing tank to the fixer fluid supplying section 36*b*. The fixer fluid supplying section 36*b* has the same configuration as those of the fixer fluid supplying section 36*a* included in the image forming apparatus 62 except that the temperature control section (not shown) is provided inside the fixer fluid tank 48. The temperature control section is provided for maintaining the constant liquid temperature of the fixer fluid 9*a*. The temperature control section comprises the temperature sensor for detecting the liquid temperature of the fixer fluid 9*a*, and the heater. A detected result due to the temperature sensor is stored in CPU (not shown) for controlling entire operation of the image forming apparatus 76. On the basis of the detected result, the CPU sends a control signal to control output of a power source (not shown) for applying voltage to the heater. By the temperature control section, it is possible to prevent the toner image from having such a decreased temperature that transfuse thereof are disturbed when the fixer fluid 9*a* is applied to the toner image. Furthermore, when toner image is transferred and fixed, the toner constituting the toner image is softened by heat, and simultaneously softened and/or swelled by the fixer fluid 9*a* so that the toner image is solidly attached to the recording medium 8, and high fixing strength can be thus obtained. A heat retention temperature of the fixer fluid 9*a* is not particularly limited as long as the heat retention temperature is not as high as a boiling temperature thereof. However, in view of calorie consumption, the heat retention temperature is preferably 35 to 45° C. In the example embodiment, the liquid temperature of the fixer fluid 9*a* in the fixer fluid tank 48 is maintained to 40° C. By means of the fixer fluid applying section 6*b*, the fixer fluid 9*a* heated to approximately 40° C. is applied by the contact system to the toner image carried by the toner carrying face 66*a* of the intermediate transfer belt 66 so that the toner constituting the toner image is made to be soften and/or swelled. In the example embodiment, since the fixer fluid 9*a* is applied to the intermediate transfer belt 66 serving as a toner image carrier which the fixer fluid 9*a* does not permeate, there is no fixer fluid 9*a* which is absorbed into the toner image carrier without acting on the toner, so that loss of the fixer fluid 9*a* is small. Accordingly, it is possible to reduce consumption of the fixer fluid 9*a*. Furthermore, since the toner image is transferred and fixed in a state where the substantially constant amount of the fixer fluid 9*a* is attached to the toner image, the toner image can be transferred and fixed without troubles under the constant condition for transfuse.

The transfuse section 77 comprises a pressure roller 40 facing the heating roller 32*a* via the intermediate transfer belt 66 which pressure-contacts the pressure roller 40, the pressure roller 40 being capable of rotating in the arrow sign 72 direction. By means of the transfuse section 77, the toner image which is softened and/or swelled by the fixer fluid 9*a* is conveyed to the pressure-contact portion between the heating roller 32*a* and the pressure roller 40 in a state where the toner image is carried by the intermediate transfer belt 66. At the pressure-contact portion, the toner image is heated by the heating roller 32*a* from an opposite side of the toner image carrying face 66*a*. At the same time, the toner image is placed and pressed on the recording member 8 supplied from the recording medium supplying section 7 in synchronization with conveyance of the toner image. The toner image is thus transferred and fixed to the recording medium 8 so that the image is formed. That is to say, in the embodiment, the intermediate transfer belt 66 is heated from a reverse side of the toner image carrying face 66*a* so that the toner image is transferred to the recording medium 8 from a side to which the fixer fluid 9*a* has been applied. On the intermediate transfer belt 66, the toner image carrying face 66*a* is formed of materials which can be easily fused when heated, but the reverse side is formed of materials which can be hardly fused when heated. When this reverse side is made to carry the toner image so as to transfer and fix the toner image to the recording medium 8, the adherence between the toner image and the recording medium 8 may be insufficient. Accordingly; the toner carrying face 66*a* is made to carry the toner image to which the fixer fluid 9*a* is applied By supplementary heating, the adherence between the toner image and the recording medium 8 is sufficiently increased so that it is possible to obtain the fixed image which has high fixing strength with the recording medium 8.

Further, in the example embodiment, the surface temperature of the heating roller 32*a* is set to 75° C. so that the temperatures of the intermediate transfer belt 66 and toner image at the contact staffing point between the toner image to which the fixer fluid 9*a* has been applied to, and the recording medium 8 are slightly lower (preferably 2 to 5° C. lower) than the temperature of the glass transition point (60° C. in the example embodiment) of the toner.

The recording medium 8 on which the image has been formed is conveyed by the conveying section 65 and discharged via the discharge rollers 56*a* and 56*b* to the catch tray 41 provided outside the image forming apparatus 76.

By means of the image forming apparatus 76, the fixer fluid 9*a* is firstly applied to the toner image carried by the toner carrying face 66*a* of the intermediate transfer belt 66 so that the toner constituting the toner image is softened and/or swelled. Sequentially, this toner image is transferred and fixed while heated so that the image is formed on the recording medium 8.

In the example embodiment, the surface temperature of the heating roller 32*a* is set to 70° C. so that the temperatures of the intermediate transfer belt 66 and toner image at the contact staffing point between the toner image and the recording medium 8 are slightly lower than the temperature of the glass transition point (60° C.) of the toner. However, the surface temperature of the heating roller 32*a* is not limited to the above value, but this temperature setting may be appropriately changed. For instance, the surface temperature of the heating roller 32*a* may be set to 80° C. so that the temperatures of the intermediate transfer belt 66 and toner image at the contact staffing point between the toner image and the recording medium 8 are higher than the temperature of the glass transition point (60° C.) of the toner. In this case, since the toner is softened by heat when the toner image is transferred and fixed, it is possible to reduce the application amount of the fixer fluid 9*a* which is applied for softening and/or swelling the toner. Moreover, compared to the heat transfer system, the application of the fixer fluid 9*a* decreases the set temperature at the time of transfuse, and reduces the calorie consumption, and shortens a length of time that the temperature rises up to the set temperature at the time of transfuse, that is a warm-up time.

Furthermore, it is possible to prevent the temperatures of the toner image and fixer fluid 9*a* from decreasing until when the toner image is transferred and fixed, and thus maintain the softened state of the toner reliably. Accordingly, the fixing strength of the toner image to the recording medium 8 can be sufficiently secured so that further less toner remains without being transferred onto the intermediate transfer belt 66.

Furthermore, since the recording temperature 8 has an increased temperature after the toner image is transferred and fixed thereto, it is possible to dry out the fixer fluid 9*a* more rapidly. This makes it possible to further enhance throughput that indicates the number of outputted sheets per hour by the image forming apparatus 76.

Further, in the example embodiment, the surface temperature of the heating roller 32*a* may be set to 140° C. so that the temperatures of the intermediate transfer belt 66 and toner image at the contact starting point between the toner image and the recording medium 8 are higher than the temperature of the softening point (120° C.) of the toner. In this case, the same effects as those in the case where the surface temperature of the heating roller 32*a*is set to 80° C., are further enhanced.

Figure 10:
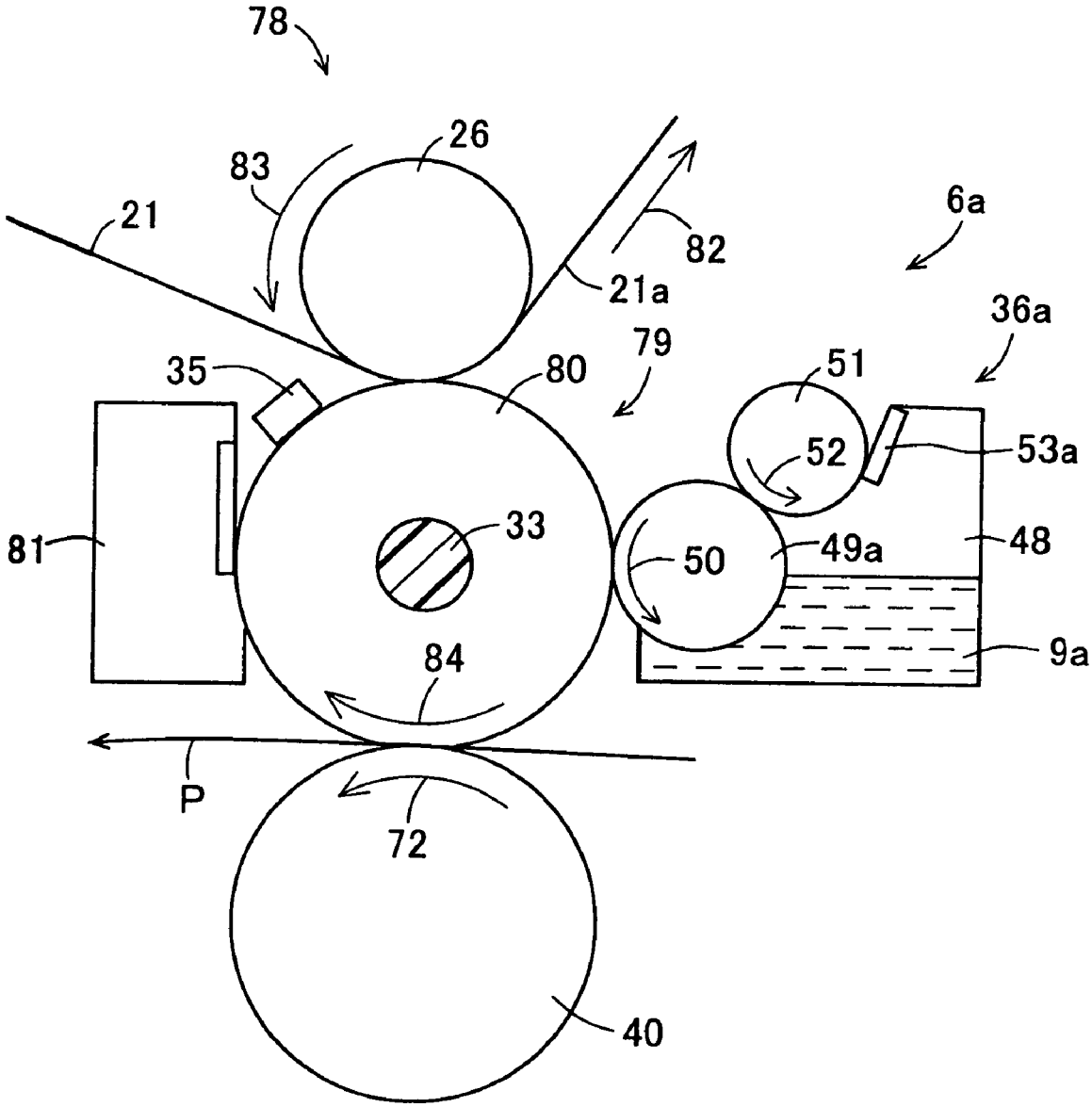
FIG. 10 is a side view schematically showing a configuration of a substantial part of the image forming apparatus according to a sixth example embodiment of the presently disclosed technology.

FIG. 10 is a side view schematically showing a configuration of a substantial part of the image forming apparatus 78 according to a sixth example embodiment of the presently disclosed technology. The image forming apparatus 78 is similar in configuration to the image forming apparatuses 1 and 62 so that corresponding parts will be denoted by the same reference numerals, and description thereof will be omitted. Further, illustration and description of the same parts will be omitted.

In the image forming apparatus 78, the multicolored toner image is transferred and fixed to the recording medium 8 at the same time as follows. The multicolored toner image formed on a toner carrying face 21*a* of the intermediate transfer belt 21 is transferred to a transfuse roller 80. The fixer fluid 9*a* is applied to the multicolored toner image in contact therewith while the multicolored toner image is heated on the transfuse roller 80 so that the toner is softened and/or swelled to be transferred to the recording medium 8.

The image forming apparatus 78 comprises a toner image forming section, an intermediate transfer section, a transfuse section 79, a conveying section 65, and a recording medium supplying section 7.

The toner image forming section is similar in configuration to the toner image forming section 2 included in the image forming apparatus 1. However, image forming units 10*y*, 10*m*, 10*c* and 10*b* are disposed from an upstream side in an arrow sign 82 direction because the intermediate transfer belt 21 moves in the arrow sign 82 direction, in other words, a moving direction of the intermediate transfer belt 21 is reversed from that of the intermediate transfer belt 21 included in the image forming apparatus 1. According to this change, rotation direction of each member inside the image forming units is also reversed. Tine image forming units 10*y*,

10*m*, 10*c* and 10*b* are disposed in a reversed order from the order of those in the image forming apparatus 1.

The intermediate transfer section is also similar in configuration to the intermediate transfer section 3 included in the image forming apparatus 1. However, the moving direction of the intermediate transfer belt 21 is changed to the arrow sign 82 direction as described above and therefore, a belt cleaner 28 faces not a support roller 27, but a support roller 25 via the intermediate transfer belt 21. The belt cleaner 28 contacts the toner carrying face 21*a* of the intermediate transfer belt 21.

The transfuse section 79 comprises a transfuse roller 80, a fixer fluid applying section 6*a*, a pressure roller 40, a cleaning section 81, and a temperature sensor 35. The transfuse roller 80 has a heater 33 therein, and is capable of rotating in an arrow sign 84 direction by driving section (not shown). The fixer fluid applying section 6*a* applies the fixer fluid 9*a* to the transfuse roller 80. The fixer fluid applying section 6*a* is provided in an order from an upstream side in a rotation direction of the transfuse roller 80. Note that in the rotation direction of the transfuse roller 80, on a downstream side of the temperature sensor 35, the transfuse roller 80 faces the support roller 26 via the intermediate transfer belt 21 which pressure-contacts the transfuse roller 80.

A roller is used as the transfuse roller 80, which roller is composed of a metallic cored bar, an elastic layer, and a surface layer, the elastic layer and the surface layer being sequentially laminated on a surface of the metallic cored bar. In the embodiment used as the transfuse roller 80 is a roller having an outer diameter of 30 mm, in which a cared bar formed of carbon steel, having a thickness of 1 mm, is covered with an elastic layer formed of silicone rubber having a volume resistance of $10^8$ to $10^9\Omega\cdot$cm, the silicone rubber having a thickness of 3 mm, and further covered with a surface layer formed of PFA, having a thickness of 20 μm. To the transfuse roller 80 is applied voltage having a potential which is opposite to the potential of charged toner, for instance, voltage of 1 kV so that the toner is electrostatically attracted and thus transferred. As the heater 33 provided inside the transfuse roller 80, a heater composed of a halogen lamp is used, for instance. The heater 33 is controlled so that the entire surface temperature of the transfuse roller 80 is uniform by a signal emitted from the CPU for controlling the entire operation of the image forming apparatus 78 on the basis of the detected result of the temperature sensor 35 for detecting the surface temperature of the transfuse roller 80.

Between the transfuse roller 80 and the intermediate transfer belt 21 is applied a transfer electric field by a voltage applying section (not shown) so that the toner image formed on the toner carrying face 21*a* of the intermediate transfer belt 21 is electrostatically transferred to the transfuse roller 80. The toner image transferred to the intermediate transfer roller 80 is heated by the heater 33 inside the transfuse roller 80 and then, the fixer fluid 9*a* is applied to the toner image.

The fixer fluid applying section 6*a* has the same configuration as that of the fixer fluid applying section 6*a* included in the image forming apparatus 62. By means of the fixer fluid applying section 6*a*, the fixer fluid supplying roller 49*a* firstly rotates in the fixer fluid 9*a* in the fixer fluid tank 48. By so doing, the fixer fluid 9*a* is attached to the surface of the fixer fluid supplying roller 49*a*. This fixer fluid 9*a* is formed into a thin layer having a substantially even thickness by the regulating roller 51, and applied to the toner image on the transfuse roller 80 at the pressure-contact portion between the fixer fluid supplying roller 49*a* and the transfuse roller 80. toner image is heated from a contact face with the transfuse roller 80, and the fixer fluid 9*a* is applied to the toner image from an outer periphery thereof so that the toner constituting the toner image is softened/swelled in the heated state. On the other hand, the excess fixer fluid 9*a* attached to the surface of the regulating roller 51 is removed from the surface of the regulating roller 51 by the removing blade 53*a*.

As just described, in the example embodiment, since the fixer fluid 9*a* is applied to the toner image on the toner image carrier (the transfuse roller 80) which is different from the intermediate transfer belt 21, such an advantage is obtained that the fixer fluid 9*a* is hardly attached to the intermediate transfer belt 21. Moreover, the toner is heated on not the intermediate transfer belt 21, but the transfuse roller 80 and therefore, the temperature of the intermediate transfer belt 21 hardly increases. This makes it possible to prevent temperatures of components of the toner image forming section from rising, and quality of the toner from changing by the fixer fluid 9*a* in the toner image forming course so that the images of high quality can be stably obtained for a long period of time.

Further, in the example embodiment, the toner image is heated from one side (the surface of the transfuse roller 80=a lower layer portion of the toner image), and the fixer fluid 9*a* is applied to the toner image from the other side (the outer periphery of the transfuse roller 80=an upper layer portion of the toner image). That is to say, the toner image is heated from a side thereof in contact with the surface of the transfuse roller 80, and the fixer fluid 9*a* is applied to a side of the toner image, facing the surface of the fixer fluid supplying roller 49*a*. Consequently, the entire toner constituting the toner image can be softened/swelled to such an extent that sufficient adherence to the recording medium 8 is obtained so that an image having high fixing strength to the recording medium 8 can be obtained. Only heating makes the toner sufficiently soften on a portion thereof in contact with the transfuse roller 80 (the lower layer portion of the toner image), but not sufficiently soften on the uppermost layer portion of the toner image in which a temperature thereof hardly increases because most of the toner is formed of a binder resin having lower heat conductivity, with the result that the adherence to the recording medium 8 may be insufficient. Accordingly, the application of the fixer fluid 9*a* from the uppermost layer side of the toner image makes it possible to sufficiently soften/swell the entire toner constituting the toner image, and enhance the adherence of the toner image to the recording medium 8. This makes it possible to obtain an image having such high fixing strength that the fixed image is not separated even when the fixed image is folded.

In the example embodiment, the pressure roller 40 pressure-contacts the transfuse roller 80 at line pressure of 10 N/cm. The toner image on the transfuse roller 80, the toner image having the toner in the softened and/or swelled state by heat and application of the fixer fluid 9*a*, is conveyed to the pressure-contact portion between the pressure roller 40 and transfuse roller 80. In synchronization with this movement, the recording medium 8 is fed from the recording medium supplying section 7 and pressed by the pressure roller 40 so that the toner image is transferred and fixed to the recording medium 8, and thus the image is formed.

The cleaning section 81 cleans out the toner, fixer fluid 9*a*, paper dust and the like, remaining on the surface of the transfuse roller 80 after the toner image has been transferred to the recording medium 8.

The temperature sensor 35 detects the surface temperature of the transfuse roller 80. The detected result is inputted to the CPU for controlling the entire operation of the image forming apparatus 78. On the basis of the detected result, the CPU sends a control signal to a power source (not shown) for applying voltage to the heater 33 so as to adjust heat generated by the heater 33.

By means of the transfuse section 79, the toner image on the intermediate transfer belt 21 is transferred to the surface of the transfer/fixing roller 80, and the fixer fluid 9*a* is applied to the toner image under heating on the transfer/fixing roller 80 so that the toner is sufficiently softened and/or swelled. The toner image is afterward transferred and fixed to the recording medium 8 so that the image is formed.

The conveying section 65 is the same as the conveying section 65 included in the image forming apparatus 62.

The recording medium supplying section 7 is the same as the recording medium supplying section 7 included in the image forming apparatus 1.

By means of the image forming apparatus 78, the toner image formed on the toner carrying face 21*a* of the intermediate transfer belt 21 by the toner image forming section, is transferred to the transfuse roller 80 and heated on the transfuse roller 80, and further the fixer fluid 9*a* is applied to the toner image under heating. The toner image is afterward transferred and fixed to the recording medium so that the image is formed. The recording medium on which the image has been formed is conveyed by the conveying section and discharged via the discharge roller to outside of the image forming apparatus 78.

In the example embodiment, the application amount of the fixer fluid 9*a* to the toner image on the transfuse roller 80 per unit area thereof is set to a constant value regardless of the temperature of the toner image. However, without being limited to the constant value, the application amount of the fixer fluid 9*a* may be changed according to the temperature of the toner image.

The application amount of the fixer fluid 9*a* can be controlled by setting the fixer fluid supplying roller 49 and regulating roller 51 to have a variable ratio of peripheral velocity therebetween, in particular by setting the regulating roller 51 to have a variable rotational speed, in the fixer fluid supplying section 36*a*. For instance, when the rotational steed of the regulating 51 increases, the amount of fixer fluid 9*a* on the fixer fluid supplying roller 49*a* is reduced so that the application amount of the fixer fluid 9*a* to the toner image can be reduced. In this constitution, when the ratio of peripheral velocity of the regulating roller 51 to that of the fixer fluid supplying roller 49*a* is 0.4, the application amount of the fixer fluid 9*a* to the toner image is 10 g/m$^2$, and when the ratio of peripheral velocity 0.5, the application amount 8 g/m$^2$, and when the ratio of the peripheral velocity 0.6, the application amount 6 g/m$^2$.

Control of the application amount will be described to be further specific. For instance, the surface temperature of the transfuse roller 80 is set to 140° C., and in a case where the surface temperature of the transfuse roller 80 is rising shortly after the image forming apparatus 78 has been activated, the ratio of peripheral velocity of the regulating roller 51 to that of the fixer fluid supplying roller 49*a* is set to 0.4 so that the application amount is made larger than usual And in a case where the surface temperature of the transfuse roller 80 reaches to 140° C. and becomes constant, the ratio of peripheral velocity can be just set to 0.5 so that the application amount is made smaller.

Further, it may be also possible that the surface temperature of the transfuse roller 80 is set to 150° C., and when the surface temperature of the transfuse roller 80 falls in a range of 120 to 140° C., the application amount of the fixer fluid 9*a* to the toner image is set to 10 g/m$^2$, and when the surface temperature of the transfuse roller 80 falls in a range of 140° C. or more, the application amount is set to 8 g/m$^2$. When the application amount is gradually controlled according to the change of the surface temperature, the toner image is fixed to the recording medium 8 with more certainty even during the warm-up.

With these configurations, a fixed image having sufficient fixing strength can be obtained because a larger amount of the fixer fluid 9*a* is applied even during the warm-up that the toner has a weak thermal fixing action from when the apparatus is activated to when the surface temperature of the transfuse roller 80 reaches to a predetermined temperature. Accordingly, it is possible to obtain the image forming apparatus which can start quickly without a standby time.

The application amount of the fixer fluid 9*a* to the toner image can be controlled by not only changing the ratio of peripheral velocity of the regulating roller 51 to the fixer fluid supplying roller 49*a*, but also pressing an elastic blade on the surface of the fixer fluid supplying roller 49*a* and changing a press force thereof, for instance.

Figure 11:
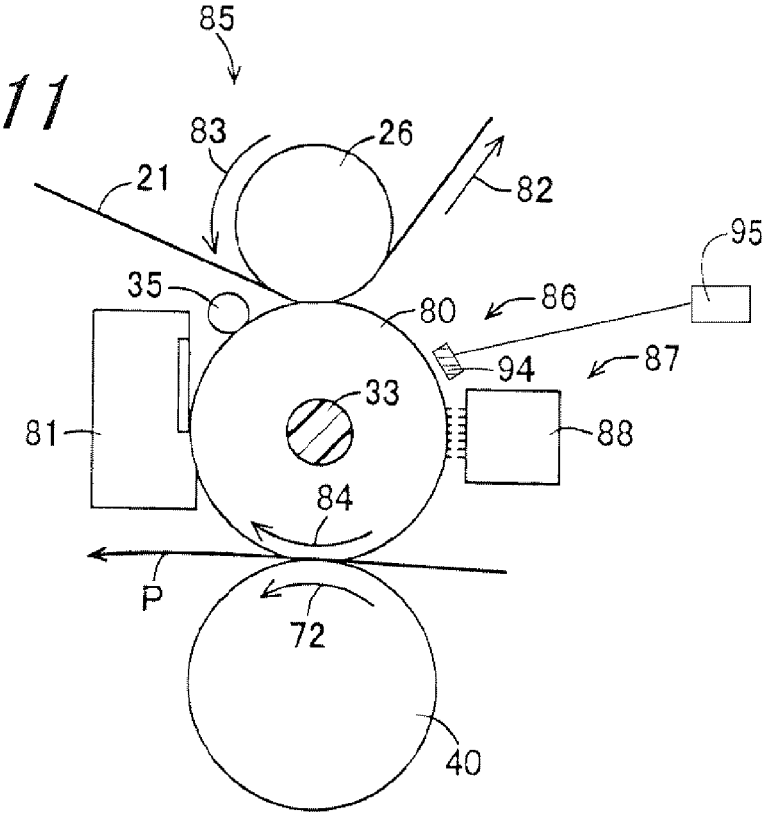
FIG. 11 is a side view schematically showing a configuration of a substantial part of an image forming apparatus 85 according to a seventh example embodiment of the presently disclosed technology.

FIG. 11 is a side view schematically showing a configuration of a substantial part of an image forming apparatus 85 according to a seventh example embodiment of the presently disclosed technology.

The image forming apparatus 85 is similar in configuration to the image forming apparatus 78 so that corresponding parts will be denoted by the same reference numerals, and description thereof will be omitted. Further, illustration and description of the same parts will be omitted.

In the image forming apparatus 85, a nozzle array 88 is used as fixer fluid applying section 87 when the fixer fluid 9*a* is applied to the toner image that is to be transferred from an intermediate transfer belt 21 to a transfuse roller 83 in the heated state due to a heater 33 provided inside the transfuse roller 80.

In the image forming apparatus 85, transfuse section 86 comprises a transfuse roller 80, a fixer fluid applying section 87, a pressure roller 40, a cleaning section 81, and a temperature section 35. The transfuse roller 80 has a heater therein. The fixer fluid applying section 87, the pressure roller 40, the cleaning section 81 and the temperature sensor 33 are sequentially disposed, around the transfuse roller 80, in the order from an upstream side in the rotation direction of the transfuse roller 80.

The fixer fluid applying section 87 comprises the nozzle array 88. The nozzle array 88 is a device having a plurality of arranged micro nozzles (not shown) for spitting micro droplets of the fixer fluid 9*a* toward the toner carrying face of the transfuse roller 80 according to an electrical control signal. An arrangement pitch of the micro nozzles is set so that the micro droplets of the fixer fluid 9*a* discharged from the micro nozzle completely cover at least a toner image carrying region of the surface of the transfuse roller 80. Moreover, in the nozzle array 88, a diameter of the micro droplet can be appropriately changed. By controlling the droplet diameter, density of the number of applied droplets (the number of dots) can be controlled so that the application amount of the fixer fluid 9*a* can be controlled within a range of 1 to 10 g/m$^2$, for instance.

By means of the nozzle array 88, the application amount of the fixer fluid 9*a* can be controlled according to an amount of attached toner on the transfuse roller 80. As discussed above, the fixer fluid applying section comprises a toner amount detecting section 94 for detecting a toner amount on the toner image; and a fixer fluid application amount control section 95 for changing the application amount of the fixer fluid based on a control signal from the toner amount detecting section. In a case where the fixer fluid 9*a* is applied to the surface of the transfuse roller 80 having a set surface temperature of 40° C., the fixer fluid 9*a* is applied with an application amount of 4 g/m$^2$ to only a part of the surface of the transfuse roller 80 having a toner amount attached thereto of 8 g/m$^2$ or more determined by an image signal. This amount of attached toner (8 g/m$^2$) is the uppermost limit of the amount of attached toner, with which the toner image can be transferred to the recording medium 8 even by the transfuse roller 80 having a set temperature of 140° C. When the amount of attached toner exceeds this value, a fixed image having insufficient fixing strength may be obtained. Accordingly, the fixer fluid 9*a* is applied so as not to obtain the image having the insufficient fixing strength.

With such a configuration, the fixer fluid 9*a* is applied to the limited part, so that the consumption of the fixer fluid 9*a* can be reduced. Since most part of the toner is formed of a binder resin having lower heat conductivity, the temperature of the uppermost layer portion of the toner image hardly increases on a part thereof to which a large amount of the toner is attached, with the result that the toner may not be sufficiently softened, and adhesion to the recording medium 8 may be insufficient. The application of the fixer fluid 9*a* compensates for decrease of adherence so that the toner constituting the entire toner image is sufficiently softened and/or swelled so that the adherence of the toner image to the recording medium 8 can be enhanced. Moreover, in a case where the fixer fluid 9*a* is applied to the toner image, the fixer fluid 9*a* is applied to a face of the toner image, which is attached to the recording medium 8. Accordingly, compared to a case where the toner image is just heated, it is possible to obtain an image having largely increased adherence and such high fixing strength that the fixed image is not separated even when the fixed image is folded. Note that the sufficient fixing strength to the recording medium 8 can be secured on a part having less amount of toner attached thereto even when the fixer fluid 9*a* is not applied because the temperature of the uppermost layer portion of the toner image sufficiently increases.

In the example embodiment, the application amount of the fixer fluid 9*a* to the toner image on the transfuse roller 80 per unit area thereof is set to a constant value regardless of the temperature of the toner image. However, without being limited to the constant value, the application amount of the fixer fluid 9*a* may be changed according to the temperature of the toner image.

For Instance, the surface temperature of the transfuse roller 80 is set to 140° C. In a case where the surface temperature of the transfuse roller 80 is rising to 140° C., the application amount needs only to be increased by 1 g/m$^2$, and in a case where the surface temperature of the transfuse roller 80 has reached to 140° C., the application amount needs only to be decreased by 1 g/m$^2$.

Further, it may be also possible that the surface temperature of the transfuse roller 80 is set to 140° C., and in a case where the surface temperature of the transfuse roller 80 is rising to 140° C., the fixer fluid 9*a* is applied at rate of 2 g/m$^2$ also to a part having the toner of less than 8 g/m$^2$ attached thereto, and in a case where the surface temperature of the transfuse roller 80 has reached to 140° C., the fixer fluid 9*a* is applied only to a part having the toner of 8 g/m$^2$ or more attached thereto.

By means of these configurations, even during the warm-up from when the apparatus is activated to when the surface temperature of the transfuse roller 80 reaches to a predetermined temperature, a fixed image having sufficient fixing strength can be obtained by applying a larger amount of the fixer fluid 9*a*. Accordingly, it is possible to obtain the image forming apparatus which can start quickly without a standby time.

Figure 12:
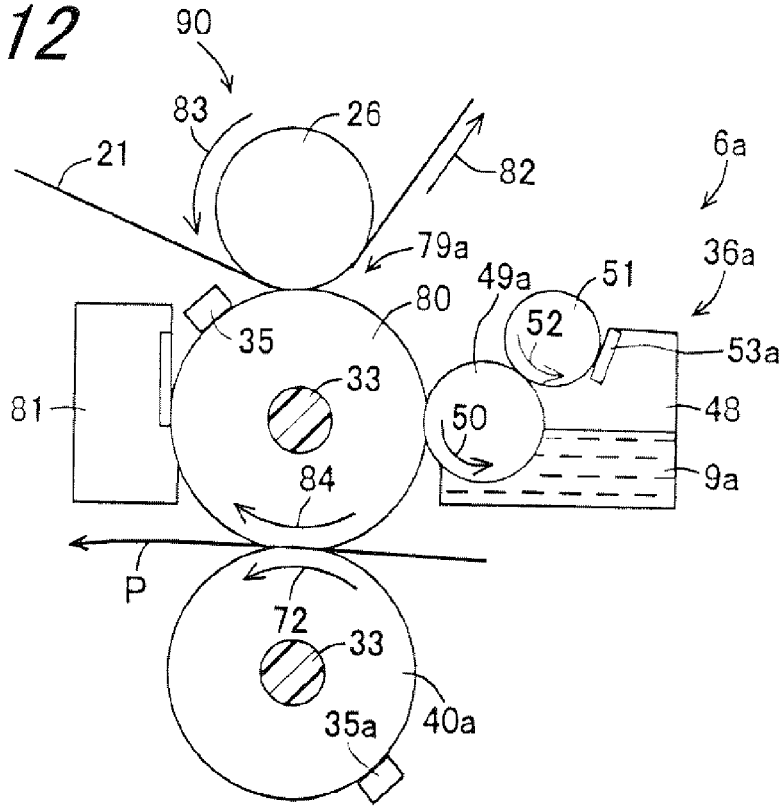
FIG. 12 is a sectional view schematically showing a configuration of a substantial part of an image forming apparatus 90 according to an eighth example embodiment of the present disclosed technology.

FIG. 12 is a sectional view schematically showing a configuration of a substantial part of an image forming apparatus 90 according to an eighth example embodiment of the presently disclosed technology.

The image forming apparatus 90 is similar in configuration to the image forming apparatus 78 so that corresponding parts will be denoted by the same reference numerals, and description thereof will be omitted. Further, illustration and description of the same parts will be omitted.

The image forming apparatus 90 has the same configuration as that of the image forming apparatus 78 except that transfuse section 79*a* comprises a temperature sensor 35*a* provided so as to contact or come close to a surface of a pressure roller 40*a*, for detecting a surface temperature of the pressure roller 40*a*; and a heater (a heater lamp) 33 inside the pressure roller 40*a*, for controlling heating operation so that the pressure roller 40*a* has a predetermined set temperature on the basis of a temperature detected signal from the temperature sensor 35*a*.

The transfuse section 79*a* of the image forming apparatus 80 comprises a transfuse roller 90, a fixer fluid applying section 6*a*, a pressure roller 40*a*, a cleaning section 91, a temperature sensor 35, and a temperature sensor 35*a*. The transfuse roller 80 has the heater 33 therein. The pressure roller 40*a* has the heater 33 therein. The fixer fluid applying section 6*a*, the pressure roller 40*a*, the cleaning section 81, and the temperature sensor 35 are sequentially disposed, around the transfuse roller 80, in the order from an upstream side in the rotation direction of the transfuse roller 80. The temperature sensor 35*a* is provided so as to contact or core close to the surface of the pressure roller 40*a*.

A detected result of the surface temperature of the pressure roller 40*a* due to the temperature sensor 35*a* is sent, as a detected result, to the CPU for controlling the entire operation of the image forming apparatus 90. The CPU sends a control signal to the fixer fluid applying section 6*a* according to the detected result so that the application amount of the fixer fluid 9*a* due to fixer fluid supplying section 36*a* is controlled. The application amount can be controlled, for instance, in the fixer fluid supplying section 36*a*, by adjusting the ratio of peripheral velocity of a fixer fluid supplying roller 49 to a regulating roller 51. In the image forming apparatus 90, according to the surface temperature of the pressure roller 40*a*, the application amount of the fixer fluid 9*a* to the toner image on the transfuse roller 80 is controlled.

The application amount of the fixer fluid 9*a* is controlled by use of the temperature sensor 35*a* as follows, for instance. The surface temperature of the pressure roller 40*a* is set to 70° C., for instance. In a case where the surface temperature of the pressure roller 40*a* is rising but not 70° C. yet shortly after the image forming apparatus 90 has been activated, the ratio of peripheral velocity of the regulating roller 51 to the fixer fluid supplying roller 49*a* is adjusted to 0.4 so that the application amount of the fixer fluid 9*a* is increased. And in a case where the surface temperature of the pressure roller 40 has reached to 70° C., the ratio of peripheral velocity may be adjusted to 0.5, and the application amount of the fixer fluid 9*a* needs only to be decreased from the value in the case where the amount of peripheral velocity is 0.4. In other words, since the surface temperature of the pressure roller 40*a* has not reached to the set temperature shortly after activation, the thermal fixing action on the pressure-contact portion with the transfuse roller 80 becomes insufficient. However, by applying a larger amount of the fixer fluid 9*a*, it is possible to obtain a fixed image having sufficient fixing strength even during the warm-up that the thermal fixing action is weak. Accordingly, it is possible to obtain the image forming apparatus which can start quickly without a standby time.

The fixer fluid 9*a* may be gradually applied according to the surface temperature of the pressure roller 40*a*. For instance, the surface temperature of the pressure roller 40*a* is set to 90° C., and the application amount is set to 10 g/m$^2$ when the surface temperature is 50° C. or lower, and the application amount 9 g/m$^2$ when the surface temperature in a range of 50 to 70° C., and the application amount 8 g/m$^2$ when the surface temperature in a range of 70 to 90° C., and the application amount 6 g/m$^2$ when the surface temperature 90° C. or more. In this case, it is possible to obtain a fixed image having high image strength regardless of the surface temperature.

According to the example embodiment, by appropriately selecting the application amount of the fixer fluid 9*a* to the toner image according to the surface temperature of a pressure member (pressure roller 40*a*), it is possible to obtain a fixed image having sufficient fixing strength even during the warm-up period that the surface temperature of the pressure member does not reach to the predetermined temperature shortly after the image forming application 90 has been activated. In addition, the higher the surface temperature of the pressure member is set to, the more the application amount of the fixer fluid 9*a* can be reduced. This makes it possible to reduce the consumption of the fixer fluid 9*a*.

In the image forming apparatus of the present technology, a fixer fluid 9 for softening and/or swelling the toner is used, but the fixer fluid is not limited to the fixer fluid 9. Any fixer fluid containing heretofore known adhesive component, cohesive component, or the like may be used. As specific examples, the adhesive components include a rubber adhesive agent having macromolecular elastomers as a major component, such as chloroprene rubber, nitrile rubber, and SBR rubber; and an emulsion adhesive agent formed of hydrophilic synthetic resin such as vinyl acetate, ethylene-vinyl acetate copolymer (EVA) and acrylic resin, the hydrophilic synthetic resin being dispersed in water. With this configuration, the adherence between the toner and the recording medium 8 is given by not only the softened and/or swelled toner but also the adhesive component or cohesive component. This makes it possible to enhance the fixing strength of the toner image to the recording medium 8.

In the image forming apparatus of the presently disclosed technology, materials, layer structure, dimension and the like of each roller are not limited to the above described materials, layer structure, dimension and the like. It is possible to use materials, layer structure, dimension and the like commonly used in this image forming field of electrophotographic system, as they are or in an appropriately changed state. The roller may be replaced by a member having no end such as a belt. Further, the intermediate transfer belt, conveying belt, or the like is described as a belt having no end, but may be in a roller form.

The image forming apparatus of the presently disclosed technology is shown as a color image forming apparatus of tandem system in each embodiment, but not limited to the tandem system. The image forming apparatus of the presently disclosed technology may be, for instance, a color image forming apparatus in which one color image is combined on every circulation of the intermediate transfer belt, which is of so-called four-rotation system. In addition, the image forming apparatus of the presently disclosed technology is not limited to the color image forming apparatus, but may be a monochromatic image forming apparatus.

Such an image forming apparatus of the presently disclosed technology is used as a copying machine, a printer, a facsimile, and a complex machine composed of two or more machines thereof, for instance.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. An image forming apparatus comprising:

a toner image forming section for forming a toner image;

a transfer section for transferring the toner image formed by the toner image forming section to a recording medium;

a heating section for heating a surface of the recording medium; and a fixer fluid applying section for applying to the toner image on the surface of the recording medium a fixer fluid for fixing toner to the recording medium by softening and/or swelling the toner;

wherein said recording medium comprises an unfixed toner carrying face;

wherein said recording medium also comprise a back side that is positioned opposite to said unfixed toner carrying face;

wherein the heating section and the fixer fluid applying section are disposed so that the surface of the recording medium is heated by the heating section from said back side of said recording medium before or during application of the fixer fluid to the recording medium by the fixer fluid applying section;

the fluid fixer applying section comprising a fixer fluid, said fixer fluid comprising at least one organic compound selected from the group consisting of an alcohol, a ketone, an ester and an ether, said toner being softened and/or swelled by said organic compound; said fixer fluid further comprising a solvent which dissolves or disperses said organic compound.

2. The image forming apparatus of claim 1, wherein at least a toner image forming region of the recording medium is heated by the heating section, and the fixer fluid is applied by the fixer fluid applying section to at least a toner image forming region of the recording medium.

3. The image forming apparatus of claim 1, wherein a heating temperature of the toner image by the heating section is higher than a temperature of a glass transition point of the toner forming the toner image.

4. The image forming apparatus of claim 1, wherein the heating temperature of the toner image by the heating section is higher than a temperature of a softening point of the toner forming the toner image.

5. An image forming apparatus comprising:

a toner image forming section for forming a toner image comprising toner;

a transfer section for transferring the toner image formed by the toner image forming section to a recording medium;

a heating section for heating a surface of the recording medium; and a fixer fluid applying section for applying to the toner image a fixer fluid for fixing said toner to the recording medium by softening and/or swelling the toner;

wherein the heating section, the fixer fluid applying section, and transfer section are disposed so that the surface of the recording medium is heated by the heating section before or during transfer of the toner image to the recording medium;

a toner amount detecting section for detecting a toner amount on the toner image; and a fixer fluid application amount control section capable of partially changing the application amount of the fixer fluid depending on a control signal from the toner amount detecting section, wherein the fixer fluid is applied to only the toner image having the toner amount that is equal to or more than a predetermined amount, the fluid fixer applying section comprising a fixer fluid, said fixer fluid comprising at least one organic compound selected from the group consisting of an alcohol, a ketone, an ester and an ether, said toner being softened and/or swelled by said organic compound; said fixer fluid further comprising a solvent which dissolves or disperses said organic compound.

6. The image forming apparatus of claim 1, further comprising a fixer fluid heat retain mg section for heating and keeping warm the fixer fluid.

7. The image forming apparatus of claim 1, wherein the fixer fluid comprises an adhesive agent for increasing adherence of the toner image to the recording medium.

8. The image forming apparatus of claim 1, wherein the toner comprises polyester as a binder resin, and a wax component of which a temperature of a glass transition point is lower than that of polyester.

9. The image forming apparatus of claim 1, wherein a volume average particle diameter of the toner is 2 μm or larger and 7 μm or smaller.

10. The image forming apparatus of claim 1, wherein the fixer fluid further comprises a release agent.

11. An image forming apparatus comprising:

a toner image forming section for forming a toner image;

an intermediate transfer section serving as a first toner image carrier for transferring the toner image formed by the toner image forming section, the intermediate transfer section including an intermediate transfer medium having at least a surface formed of a material which is not permeated by a fixer fluid for fixing the toner image to a recording medium by softening and/or swelling a toner;

a second toner image carrier;

a heating section for heating the intermediate transfer medium or the second toner image carrier;

a fixer fluid applying section for applying the fixer fluid to said toner image being transferred by the intermediate transfer medium or the second toner image carrier;

the fluid fixer applying section comprising a fixer fluid, said fixer fluid comprising at least one organic compound selected from the group consisting of an alcohol, a ketone, an ester and an ether, said toner being softened and/or swelled by said organic compound; said fixer fluid further comprising a solvent which dissolves or disperses said organic compound; and a transfuse section for transferring and fixing to the recording medium the toner image to which the fixer fluid has been applied;

wherein said recording medium comprises an unfixed toner carrying face;

wherein said recording medium also comprise a back side that is positioned opposite to said unfixed toner carrying face;

wherein the heating section and the fixer fluid applying section are disposed so that the intermediate transfer medium or the second toner image carrier is heated by the heating section from said back side of said recording medium before or during application of the fixer fluid to the intermediate transfer medium or the second toner image carrier by the fixer fluid applying section.

12. The image forming apparatus of claim 11, wherein at least a toner image forming region of the intermediate transfer medium or the second toner image carrier in which the toner image has been formed is heated by the heating section, and the fixer fluid is applied by the fixer fluid applying section to at least the toner image forming region of the intermediate transfer medium or the second toner image carrier.

13. The image forming apparatus of claim 11, wherein a heating temperature of the toner image by the heating section is higher than a temperature of a glass transition point of the toner.

14. The image forming apparatus of claim 11, wherein the heating temperature of the toner image by the heating section is higher than a temperature of a softening point of the toner forming the toner image.

15. The image forming apparatus of claim 11, wherein the transfuse section further comprises the second toner image carrier capable of carrying the toner image on a surface thereof, the second toner image carrier having the heating section therein, and the fixer fluid applying section is provided so as to apply the fixer fluid to the toner image carried by the second toner image carrier.

16. The image forming apparatus of claim 15, wherein the transfuse section comprises:

a temperature detecting section for detecting a surface temperature of the second toner image carrier; and a first application amount control section for controlling an application amount of the fixer fluid applied to the toner image by the fixer fluid applying section according to a detected result from the temperature detecting section.

17. The image forming apparatus of claim 16, wherein the first application amount control section controls operation of the fixer fluid applying section so as to apply a larger amount of the fixer fluid when the surface temperature of the second toner image carrier, detected by the temperature detecting section, is lower than the first predetermined temperature, compared to the application amount at a time when the surface temperature of the second toner image carrier is equal to or higher than a first predetermined temperature.

18. The image forming apparatus of claim 15, wherein the transfuse section further comprises:

a pressure member in pressure contact with the second toner image carrier via the recording medium;

a pressure member temperature detecting section for detecting a surface temperature of the pressure member; and an application amount control section for controlling the application amount of the fixer fluid applied to the toner image by the fixer fluid applying section according to a detected result from the pressure member temperature detecting section, wherein the application amount control section controls the operation of the fixer fluid applying section so as to apply a larger amount of the fixer fluid when the surface temperature of the pressure member, detected by the pressure member temperature detecting section, is lower than a predetermined temperature, compared to the application amount at a time when the surface temperature of the pressure member is equal to or higher than the predetermined temperature.

19. An image forming apparatus comprising:

a toner image forming section for forming a toner image;

an intermediate transfer section serving as a first toner image carrier for transferring the toner image formed by the toner image forming section, the intermediate transfer section including an intermediate transfer medium having at least a surface formed of a material which is not permeated by a fixer fluid for fixing the toner image to a recording medium by softening and/or swelling a toner;

a heating section for heating the intermediate transfer medium or another toner image carrier different therefrom;

a fixer fluid applying section for applying the fixer fluid to the intermediate transfer medium or the other toner image carrier; and a transfuse section for transferring and fixing to the recording medium the toner image to which the fixer fluid has been applied, wherein the heating section and the fixer fluid applying section are disposed so that the intermediate transfer medium or the other second toner image carrier is heated by the heating section before or during application of the fixer fluid to the intermediate transfer medium or the other toner image carrier by the fixer fluid applying section; and wherein the fixer fluid applying section comprises:

a toner amount detecting section for detecting a toner amount of the toner image; and a fixer fluid application amount control section capable of partially changing an application amount of the fixer fluid depending on a control signal from the toner amount detecting section, wherein the fixer fluid is applied to the toner image only if the toner amount of the toner image is equal to or more than a predetermined amount, the fluid fixer applying section comprising a fixer fluid, said fixer fluid comprising at least one organic compound selected from the group consisting of an alcohol, a ketone, an ester and an ether, said toner being softened and/or swelled by said organic compound; said fixer fluid further comprising a solvent which dissolves or disperses said organic compound.

20. The image forming apparatus of claim 11, further comprising a fixer fluid heat retain mg section for heating and keeping warm the fixer fluid.

21. The image forming apparatus of claim 11, wherein the fixer fluid comprises an adhesive agent for increasing adherence of the toner image to the recording medium.

22. The image forming apparatus of claim 11, wherein the toner comprises polyester as a binder resin, and a wax component of which a temperature of a glass transition point is lower than that of polyester.

23. The image forming apparatus of claim 11, wherein a volume average particle diameter of the toner is 2 μm or larger and 7 μm or smaller.

24. The image forming apparatus of claim 11, wherein the fixer fluid further comprises a release agent.

25. An image forming apparatus comprising:

a toner image forming section for forming a toner image;

an intermediate transfer section serving as a first toner image carrier for transferring the toner image formed by the toner image forming section, the intermediate transfer section including an intermediate transfer medium having at least a surface formed of a material which is not permeated by a fixer fluid for fixing the toner image to a recording medium by softening and/or swelling a toner;

a second toner image carrier;

a heating section for heating the intermediate transfer medium or the second toner image carrier;

a fixer fluid applying section for applying the fixer fluid to the toner image being transferred by the intermediate transfer medium or the second toner image carrier;

the fluid fixer applying section comprising a fixer fluid, said fixer fluid comprising at least one organic compound selected from the group consisting of an alcohol, a ketone, an ester and an ether, said toner being softened and/or swelled by said organic compound; said fixer fluid further comprising a solvent which dissolves or disperses said organic compound; and a transfuse section for transferring and fixing to the recording medium the toner image to which the fixer fluid has been applied;

wherein said recording medium comprises an unfixed toner carrying face;

wherein said recording medium also comprise a back side that is positioned opposite to said unfixed toner carrying face;

wherein the heating section and the transfuse section are disposed so that the intermediate transfer medium or the second toner image carrier is heated by the heating section from said back side of said recording medium during transfuse of the toner image to the recording medium by the transfuse section.

26. The image forming apparatus of claim 25, wherein at least a toner image forming region of the intermediate transfer medium or the second toner image carrier in which the toner image has been formed is heated by the heating section, and the fixer fluid is applied by the fixer fluid applying section to at least the toner image forming region of the intermediate transfer medium or the second toner image carrier.

27. The image forming apparatus of claim 25, wherein a heating temperature of the toner image by the heating section is higher than a temperature of a glass transition point of the toner.

28. The image forming apparatus of claim 25, wherein the heating temperature of the toner image by the heating section is higher than a temperature of a softening point of the toner.

29. The image forming apparatus of claim 25, wherein the transfuse section further comprises the second toner image carrier capable of carrying the toner image on a surface thereof, the second toner image carrier having the heating section therein, and the fixer fluid applying section is provided so as to apply the fixer fluid to the toner image carried by the second toner image carrier.

30. The image forming apparatus of claim 29, wherein the transfuse section comprises:

a temperature detecting section for detecting a surface temperature of the second toner image carrier; and a first application amount control section for controlling an application amount of the fixer fluid applied to the toner image by the fixer fluid applying section according to a detected result from the temperature detecting section.

31. The image forming apparatus of claim 30, wherein the first application amount control section controls operation of the fixer fluid applying section so as to apply a larger amount of the fixer fluid when the surface temperature of the second toner image carrier, detected by the temperature detecting section, is lower than a first predetermined temperature, compared to the application amount at a time when the surface temperature of the second toner image carrier is equal to or higher than the first predetermined temperature.

32. The image forming apparatus of claim 29, wherein the transfuse section further comprises:

a pressure member in pressure contact with the second toner image carrier via the recording medium;

a pressure member temperature detecting section for detecting a surface temperature of the pressure member; and an application amount control section for controlling the application amount of the fixer fluid applied to the toner image by the fixer fluid applying section according to a detected result from the pressure member temperature detecting section, wherein the second application amount control section controls the operation of the fixer fluid applying section so as to apply a larger amount of the fixer fluid when the surface temperature of the pressure member, detected by the pressure member temperature detecting section, is lower than a predetermined temperature, compared to the application amount at a time when the surface temperature of the pressure member is equal to or higher than the predetermined temperature.

33. An image forming apparatus comprising:

a toner image forming section for forming a toner image;

an intermediate transfer section serving as a first toner image carrier for transferring the toner image formed by the toner image forming section, the intermediate transfer section including an intermediate transfer medium having at least a surface formed of a material which is not permeated by a fixer fluid for fixing the toner image to a recording medium by softening and/or swelling a toner;

a heating section for heating the intermediate transfer medium or another toner image carrier different therefrom;

a fixer fluid applying section for applying the fixer fluid to the toner image; and a transfuse section for transferring and fixing to the recording medium the toner image to which the fixer fluid has been applied, wherein the heating section and the transfuse section are disposed so that the intermediate transfer medium or the other second toner image carrier is heated by the heating section during transfuse of the toner image to the recording medium by the transfuse section;

wherein the fixer fluid applying section comprises:

a toner amount detecting section for detecting a toner amount of the toner image; and a fixer fluid application amount control section capable of partially changing an application amount of the fixer fluid depending on a control signal from the toner amount detecting section, and wherein the fixer fluid is applied to the toner image only if the toner amount of the toner image is equal to or more than the predetermined amount, the fluid fixer applying section comprising a fixer fluid, said fixer fluid comprising at least one organic compound selected from the group consisting of an alcohol, a ketone, an ester and an ether, said toner being softened and/or swelled by said organic compound: said fixer fluid further comprising a solvent which dissolves or disperses said organic compound.

34. The image forming apparatus of claim 25, further comprising An image forming apparatus comprising:

a toner image forming section for forming a toner image;

an intermediate transfer section serving as a first toner image carrier for transferring the toner image formed by the toner image forming section, the intermediate transfer section including an intermediate transfer medium having at least a surface formed of a material which is not permeated by a fixer fluid for fixing the toner image to a recording medium by softening and/or swelling a toner;

a heating section for heating the intermediate transfer medium or another toner image carrier different therefrom;

a fixer fluid applying section for applying the fixer fluid to the toner image;

a fixer fluid temperature control section for heating and keeping the fixer fluid warm; and a transfuse section for transferring and fixing to the recording medium the toner image to which the fixer fluid has been applied;

wherein the heating section and the transfuse section are disposed so that the intermediate transfer medium or the other second toner image carrier is heated by the heating section during transfuse of the toner image to the recording medium by the transfuse section.

35. The image forming apparatus of claim 25, wherein the fixer fluid comprises an adhesive agent for increasing adherence of the toner image to the recording medium.

36. The image forming apparatus of claim 25, wherein the toner comprises polyester as a binder resin, and a wax component of which a temperature of a glass transition point is lower than that of polyester.

37. The image forming apparatus of claim 25, wherein a volume average particle diameter of the toner is 2 μm or larger and 7 μm or smaller.

38. The image forming apparatus of claim 25, wherein the fixer fluid further comprises a release agent.

39. An image forming apparatus comprising:

a toner image forming section for forming a toner image;

an intermediate transfer section serving as a toner image carrier for transferring the toner image formed by the toner image forming section, the intermediate transfer section including an intermediate transfer medium having at least a surface formed of a material which is not permeated by a fixer fluid for fixing the toner image to a recording medium by softening and/or swelling a toner;

a fixer fluid applying section for applying the fixer fluid to at least a toner image forming region of the intermediate transfer medium in which the toner image has been formed;

the fluid fixer applying section comprising a fixer fluid, said fixer fluid comprising at least one organic compound selected from the group consisting of an alcohol, a ketone, an ester and an ether, said toner being softened and/or swelled by said organic compound; said fixer fluid further comprising a solvent which dissolves or disperses said organic compound;

a heating section for heating at least a toner image forming region of the intermediate transfer medium; and a transfuse section for transferring and fixing to the recording medium the toner image to which the fixer fluid has been applied;

wherein said recording medium comprises an unfixed toner carrying face;

wherein said recording medium also comprise a back side that is positioned opposite to said unfixed toner carrying face;

wherein the heating section, the fixer fluid applying section, and the transfuse section are disposed so that the toner image forming region is heated by the heating section from said back side of said recording medium after the fixer fluid is applied to the toner image forming region by the fixer fluid applying section, and a region of the intermediate transfer medium, which is in contact with the recording medium, is heated by the heating section.

40. The image forming apparatus of claim 39, wherein a heating temperature of the toner image by the heating section is higher than a temperature of a glass transition point of the toner.

41. The image forming apparatus of claim 39, wherein the heating temperature of the toner image by the heating section is higher than a temperature of a softening point of the toner.

42. The image forming apparatus of claim 39, further comprising a fixer fluid heat retaining section for heating and keeping warm the fixer fluid.

43. The image forming apparatus of claim 39, wherein the fixer fluid comprises an adhesive agent for increasing adherence of the toner image to the recording medium.

44. The image forming apparatus of claim 39, wherein the toner comprises polyester as a binder resin, and a wax component of which a temperature of a glass transition point is lower than that of polyester.

45. The image forming apparatus of claim 39, wherein a volume average particle diameter of the toner is 2 μm or larger and 7 μm or smaller.

46. The image forming apparatus of claim 39, wherein the fixer fluid further comprises a release agent.

* * * * *